US006584640B2

(12) United States Patent
Vanderlinden

(10) Patent No.: US 6,584,640 B2
(45) Date of Patent: Jul. 1, 2003

(54) LARGE AREA SURFACE CLEANING TOOL FOR SUCTIONING BOTH DUST AND DEBRIS

(76) Inventor: Roger P. Vanderlinden, 73 Sherman Ave. S., Hamilton, Ontario (CA), L8M 2P8

( * ) Notice: Subject to any disclaimer, the term of this patent is extended or adjusted under 35 U.S.C. 154(b) by 0 days.

(21) Appl. No.: 09/811,586

(22) Filed: Mar. 20, 2001

(65) Prior Publication Data

US 2002/0133903 A1 Sep. 26, 2002

(51) Int. Cl.[7] ..... A47L 9/02
(52) U.S. Cl. ..... 15/418; 15/415.1; 15/416
(58) Field of Search ..... 15/314, 331, 354, 15/415.1, 418, 422, 416, 420

(56) References Cited

U.S. PATENT DOCUMENTS

| | | | | | |
|---|---|---|---|---|---|
| 2,649,610 | A | * | 8/1953 | Segesman | 15/416 |
| 3,238,557 | A | * | 3/1966 | Foster | 15/422 |
| 3,491,399 | A | * | 1/1970 | Dolan et al. | 15/354 |
| 3,862,469 | A | * | 1/1975 | Burgoon | 15/418 |
| 3,949,422 | A | * | 4/1976 | Sato et al. | 360/118 |
| 3,984,894 | A | * | 10/1976 | Brock et al. | 15/418 |
| 4,395,794 | A | * | 8/1983 | Duncan | 15/340.1 |
| 4,458,378 | A | * | 7/1984 | Helmes | 15/401 |
| 4,467,495 | A | * | 8/1984 | Fish et al. | 15/354 |
| 4,573,236 | A | * | 3/1986 | Dyson | 15/333 |
| 4,706,327 | A | * | 11/1987 | Getz et al. | 15/354 |
| 4,723,338 | A | * | 2/1988 | Otsubo | 15/331 |
| 4,776,059 | A | * | 10/1988 | Worwag | 15/331 |
| 4,864,681 | A | * | 9/1989 | Hult et al. | 15/367 |
| 4,888,852 | A | * | 12/1989 | Varin | 15/373 |
| 5,123,141 | A | * | 6/1992 | Erickson et al. | 15/373 |
| 5,432,975 | A | * | 7/1995 | Hilmanowski | 15/354 |
| 5,553,349 | A | * | 9/1996 | Kilstrom et al. | 15/360 |
| 5,604,950 | A | * | 2/1997 | Stern | 15/418 |
| 5,642,864 | A | * | 7/1997 | Middlesworth et al. | 15/418 |
| 5,839,157 | A | * | 11/1998 | Strauser et al. | 15/340.1 |
| 5,839,161 | A | * | 11/1998 | Liang | 15/393 |
| 5,970,577 | A | * | 10/1999 | Kim | 15/398 |
| 5,974,625 | A | * | 11/1999 | Garner | 15/333 |
| 5,983,447 | A | * | 11/1999 | Boomgaarden | 15/340.1 |
| 6,039,817 | A | * | 3/2000 | Payne | 134/21 |
| 6,122,798 | A | * | 9/2000 | Kobayashi et al. | 15/386 |
| 6,125,500 | A | * | 10/2000 | Kat | 15/344 |

* cited by examiner

*Primary Examiner*—Theresa T. Snider

(57) ABSTRACT

A hand-manipulable surface cleaning tool for suctioning both dust and debris from a surface being cleaned comprises a housing defining a substantially hollow interior, and having a perimeter wall portion that terminates downwardly in a surface facing peripheral bottom edge that defines a suctioning bottom opening in dust transfer relation with a dust and debris outlet, and having a debris passing opening disposed in the perimeter wall portion and in debris transfer relation with the dust and debris outlet. The dust and debris outlet is connectable to a hand wand for delivery of dust and debris to a vacuum source. A selectively movable portion is operatively mounted on the housing for movement between an open configuration whereat debris is admitted through the debris passing opening and a closed configuration whereat debris is precluded from being admitted through the debris passing opening.

26 Claims, 19 Drawing Sheets

LARGE AREA SURFACE CLEANING TOOL FOR SUCTIONING BOTH DUST AND DEBRIS

FIELD OF THE INVENTION

The present invention relates to large area surface cleaning tools, and more particularly relates to large area surface cleaning tools for suctioning both dust and debris from a surface.

BACKGROUND OF THE INVENTION

It is well known that vacuum cleaners employ various types of cleaning tools or attachments each specifically designed to clean a particular type, shape or size of surface. For instance, large area surface cleaning tools are designed specifically for cleaning large surface areas, such as floors, and the like. Such large area surface cleaning tools include a housing with a suctioning bottom opening having a large cross-sectional area, with the bottom opening being defined by a perimeter wall. The bottom edge of the perimeter wall may be flat or may be ridged, or may comprise downwardly extending brush bristles or rubber squeegees in the case of wet vacuum tools. In any case, in use, the bottom edge of the peripheral wall remains generally in close proximity to the floor in order to maintain a suctioning force sufficient enough to urge dust on the surface being cleaned into the interior of the housing of the large area surface cleaning tool.

An elongate wand is either permanently or removably connected in suctioning relation to the housing, which elongate wand has an internal passageway having a significantly smaller cross-sectional area than the large cross-sectional area of the bottom opening of the large area surface cleaning tool.

There are several inter-related design factors to be considered in the design of a vacuum cleaner and the specific tools that are used with it, such as large area surface cleaning tools. In general, vacuum cleaners and their tools are designed to pick up dust, debris, litter, and so on, quickly and powerfully, in order to maximize vacuuming effectiveness, including minimizing the time spent vacuuming.

In order to maximize vacuuming effectiveness, the airflow (measured in volume of air per unit time) and the suction (typically measured by the height of a column of water that can be raised) generated by the suctioning unit must be optimized. However, it is well known that suctioning units that have high air flow tend to have less than ideal suction capability, and suctioning units that have high suction tend to have less than ideal air flow. Accordingly, even for powerful industrial type vacuum cleaners, the practical limits for air flow and suction are easily reached. Therefore, the cleaning capability of a vacuum cleaner's tools is correspondingly limited. Moreover, fine particulate filters that are incorporated into many modern vacuum cleaners can filter only so much air per unit time, thus providing yet another barrier to maximizing the effectiveness of a vacuum cleaner by merely increasing the airflow and suction.

In the specific case of large area surface cleaning tools, it is well known they should be as wide as possible in order to permit vacuuming of an area as quickly as possible. Further, due to the above discussed air flow and suction limitations, they should be quite narrow in depth from front to back in order to minimize the cross-sectional area of the suctioning bottom opening. Even with a narrow as practical depth from front to back, large area surface cleaning tools have a maximum width of about two feet.

Another necessary consideration is that there is also a maximum overall space between the tool and the floor in order to maintain sufficient airflow and suctioning into the interior of the tool. If this maximum overall space is exceeded, the airflow and suction will be too low to cause effective cleaning. Accordingly, many surface cleaning tools are made to suction only fine debris, such as dust and other fine particulate matter.

However, when using such a large area surface cleaning tool to vacuum a large generally flat surface such as a floor, it is common to encounter small pieces of debris, especially when cleaning shop floors and in industrial situations such as warehouse floors. These small pieces of debris are too large to pass between the bottom edge of a surface cleaning tool and the surface being cleaned, even though the debris may be small enough to be suctioned up by the vacuum cleaner, and are merely pushed around the surface by the large area surface cleaning tool. In order to suction these larger pieces of debris, the large area surface cleaning tool must be lifted up off the surface and then be accurately set down directly onto the debris and the bottom edge of the peripheral wall of the housing must again come into close proximity with the surface being cleaned in order to establish sufficient airflow to urge the debris into the inlet end of the elongate wand. This method is highly undesirable, especially in industrial situations, where the large area surface cleaning tools are heavy. Also, such lifting of a large area surface cleaning tool must typically be done with two hands, even though generally pushing it around can be accomplished with one hand.

Alternatively, some floor tools have small gaps between their bottom edge and the surface being cleaned, which gaps permit the suctioning of small debris, such as sawdust and small woodchips and the like, but not larger debris. However, such gaps are included at the sacrifice of width of the tool by virtue of compromised vacuum and air flow to the outer ends of the tool. Still, it is necessary to lift up the tool and set it back down in order to pick up large debris.

Furthermore, large area surface cleaning tools often have another significant drawback. They may be too narrow from front to back to suction debris between the front and back portions of the perimeter wall. This relationship is even narrower in the case of wet vacuum tools. In this case, the suctioning hose that connects to the wand can be separated from the elongate wand and the user can bend down and suction up debris directly with the hose. However, this is also highly undesirable since it is labour intensive and time consuming.

It is an object of the present invention to provide a large area surface cleaning tool that permits suctioning of both dust and debris from a surface without having to pick up the head and set it down onto debris.

It is another object of the present invention to provide a large area surface cleaning tool that permits suctioning of both dust and debris from a surface while manipulating the tool with one hand.

It is a further object of the present invention to provide a large area surface cleaning tool that permits suctioning of both dust and debris from a surface without separating the tool from a suctioning hose.

It is still a further object of the present invention to provide a large area surface cleaning tool that permits suctioning of both dust and debris from a surface with increased effectiveness and efficiency.

SUMMARY OF THE INVENTION

In accordance with one aspect off the present invention, there is disclosed a novel hand-manipulable surface cleaning tool for suctioning both dust and debris from a surface being cleaned. The hand-manipulable surface cleaning tool comprises a housing defining a substantially hollow interior, and having a perimeter wall portion that terminates downwardly in a surface facing peripheral bottom edge that defines a suctioning bottom opening in dust transfer relation with a dust and debris outlet disposed in the housing, and having at least one debris passing opening disposed in the perimeter wall portion and in debris transfer relation with the dust and debris outlet. The dust and debris outlet is connectable to a hand wand means for delivery of dust and debris to a vacuum source. At least one selectively movable portion is operatively mounted on the housing for movement between an open configuration whereat debris is admitted through the debris passing opening and a closed configuration whereat debris is precluded from being admitted through the debris passing opening. A means is provided for moving the selectively movable portion between the closed configuration and the open configuration.

In accordance with another aspect of the present invention, there is disclosed a novel hand-manipulable surface cleaning tool for suctioning both dust and debris from a surface being cleaned. The hand-manipulable surface cleaning tool comprises a housing defining a substantially hollow interior, and having a perimeter wall portion that terminates downwardly in a surface facing peripheral bottom edge that defines a suctioning bottom opening in dust transfer relation with a dust and debris outlet, and having at least one debris passing opening disposed in the perimeter wall portion and in debris transfer relation with the dust and debris outlet disposed in the housing. The dust and debris outlet is removably connectable in dust and debris delivery relation to a vacuum source. At least one selectively movable portion is operatively mounted on the housing for movement between an open configuration whereat debris is admitted through the debris passing opening and a closed configuration whereat debris is precluded from being admitted through the debris passing opening. A means is provided for moving the selectively movable portion between the closed configuration and the open configuration.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the large area surface cleaning tool according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 4A:
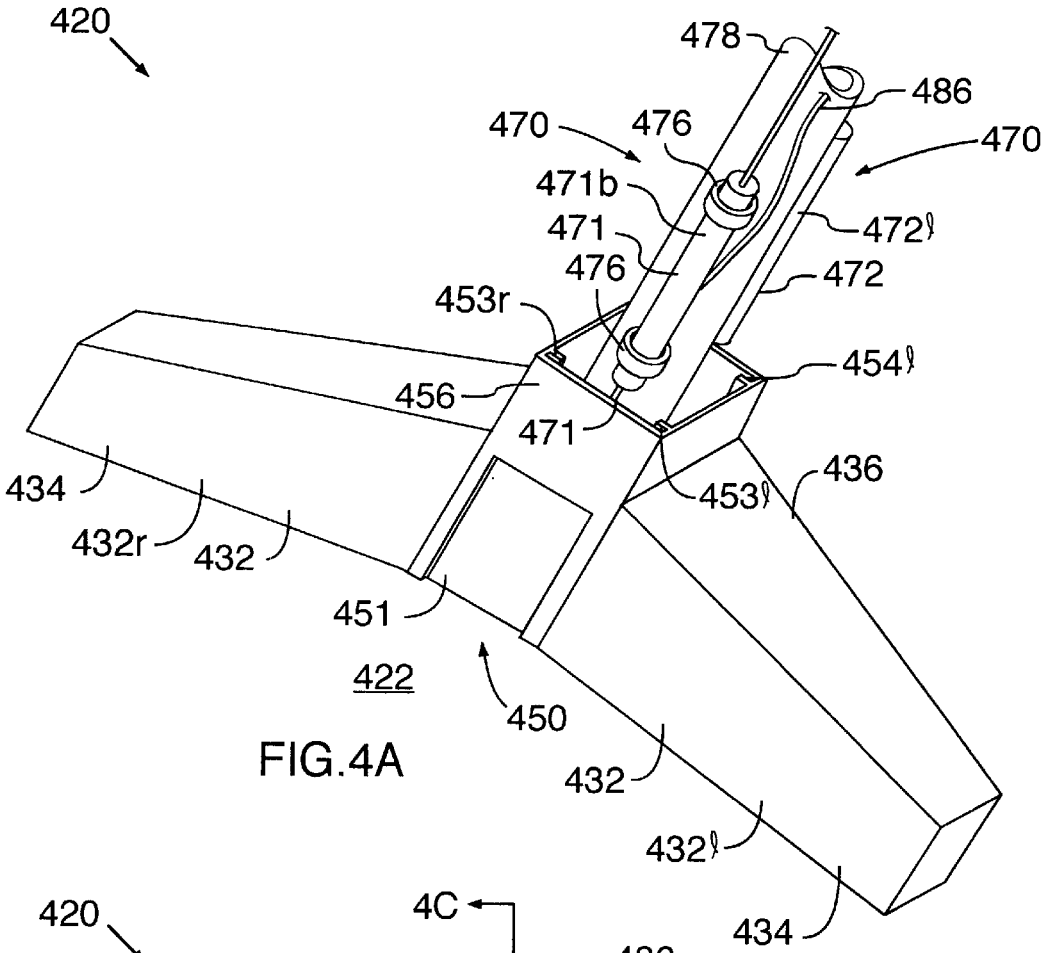
FIG. 4A is a perspective view of a fourth preferred embodiment of the large area surface cleaning tool according to the present invention, with the front and rear door in a closed position, but showing only the front door.
Figure 4B:
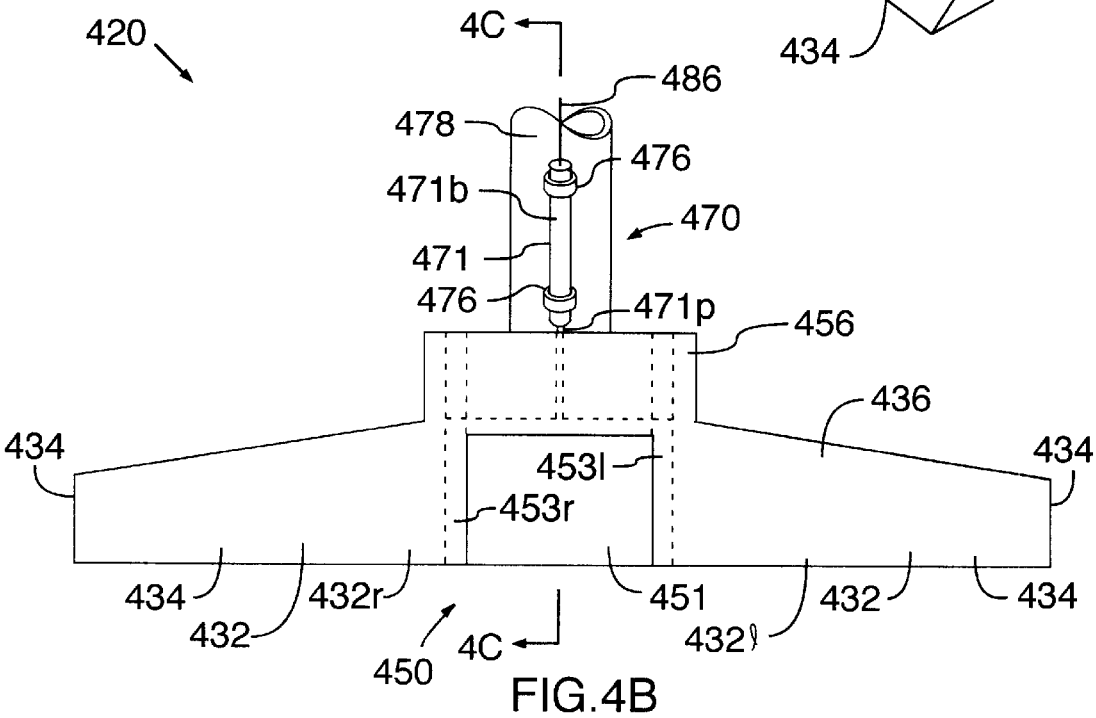
FIG. 4B is a front elevational view of the fourth preferred embodiment large area surface cleaning tool of FIG. 4A.
Figure 4C:
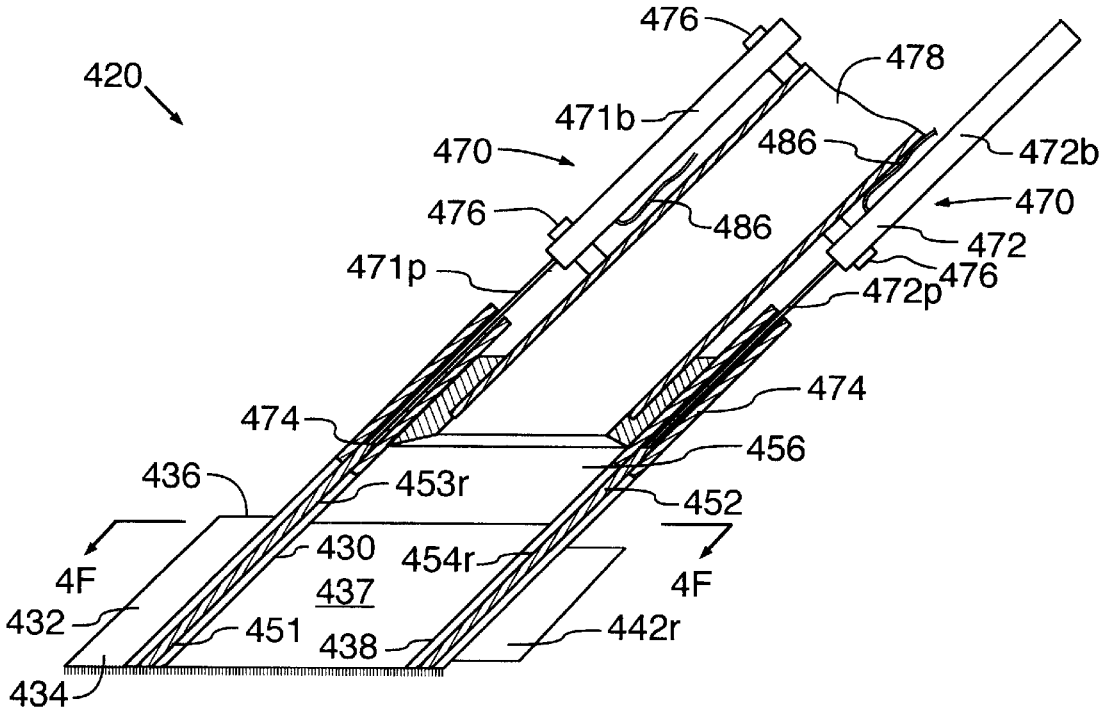
FIG. 4C is a cross-sectional side elevational view of the fourth preferred embodiment large area surface cleaning tool of FIG. 4A, taken along section line 4C—4C.
Figure 4D:
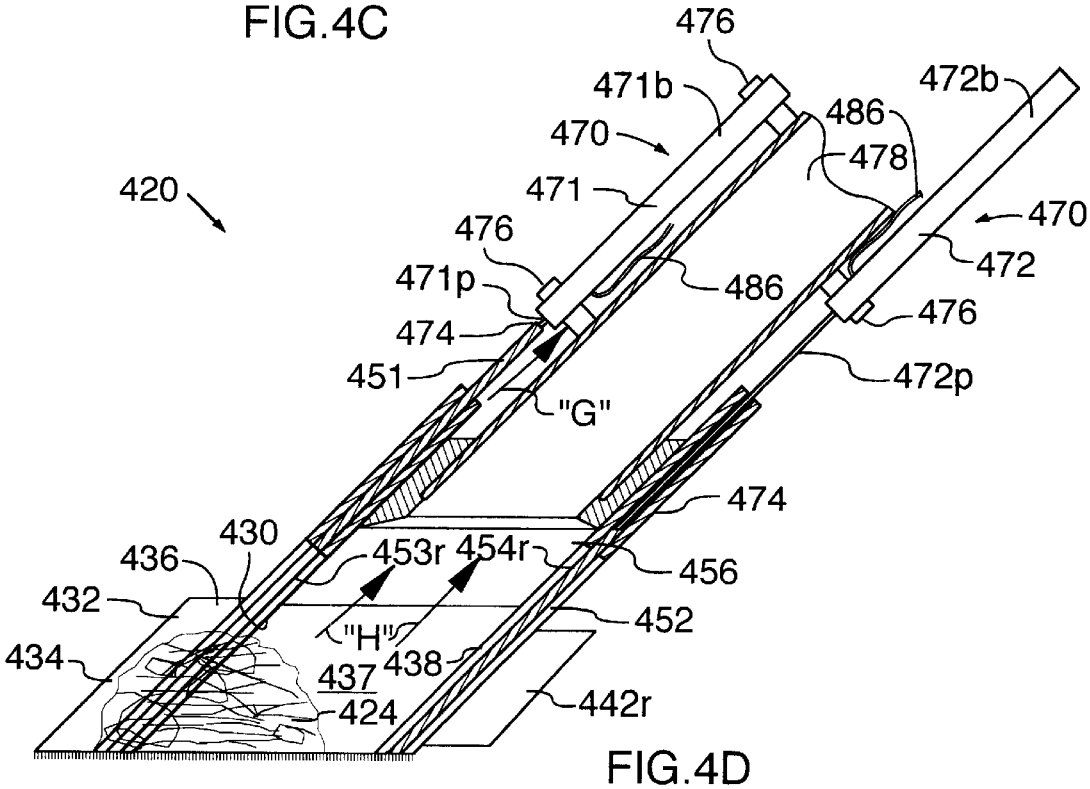
FIG. 4D is a cross-sectional side elevational view similar to FIG. 4C, but with the front door in an open position, and with debris entering into the interior of the housing.
Figure 4E:
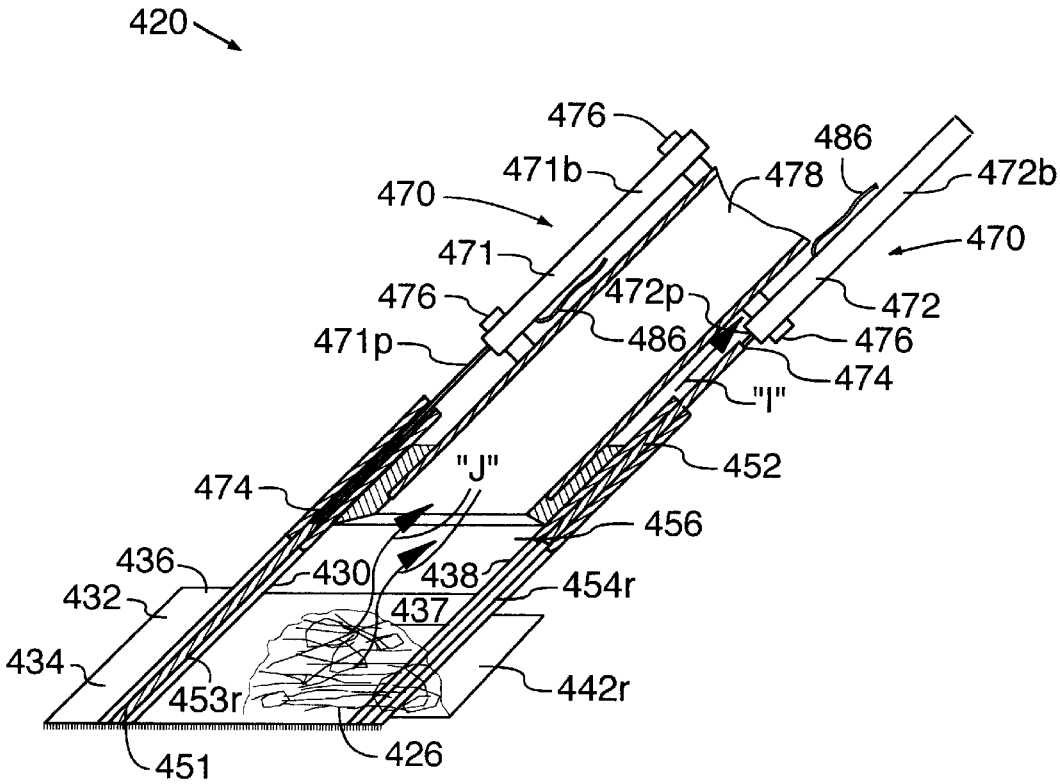
FIG. 4E is a cross-sectional side elevational view similar to FIG. 4C, but with the back door in an open position, and with debris entering into the interior of the housing.
Figure 4F:
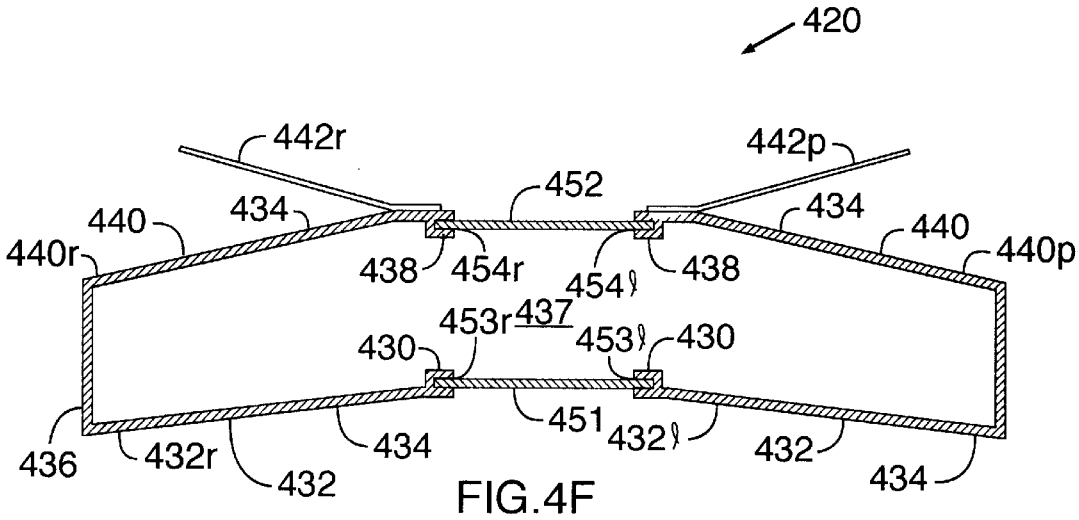
FIG. 4F is a cross-sectional top plan view of the fourth preferred embodiment large area surface cleaning tool of FIG. 4A, taken along section line 4F—4F of FIG. 4C.
Figure 4G:
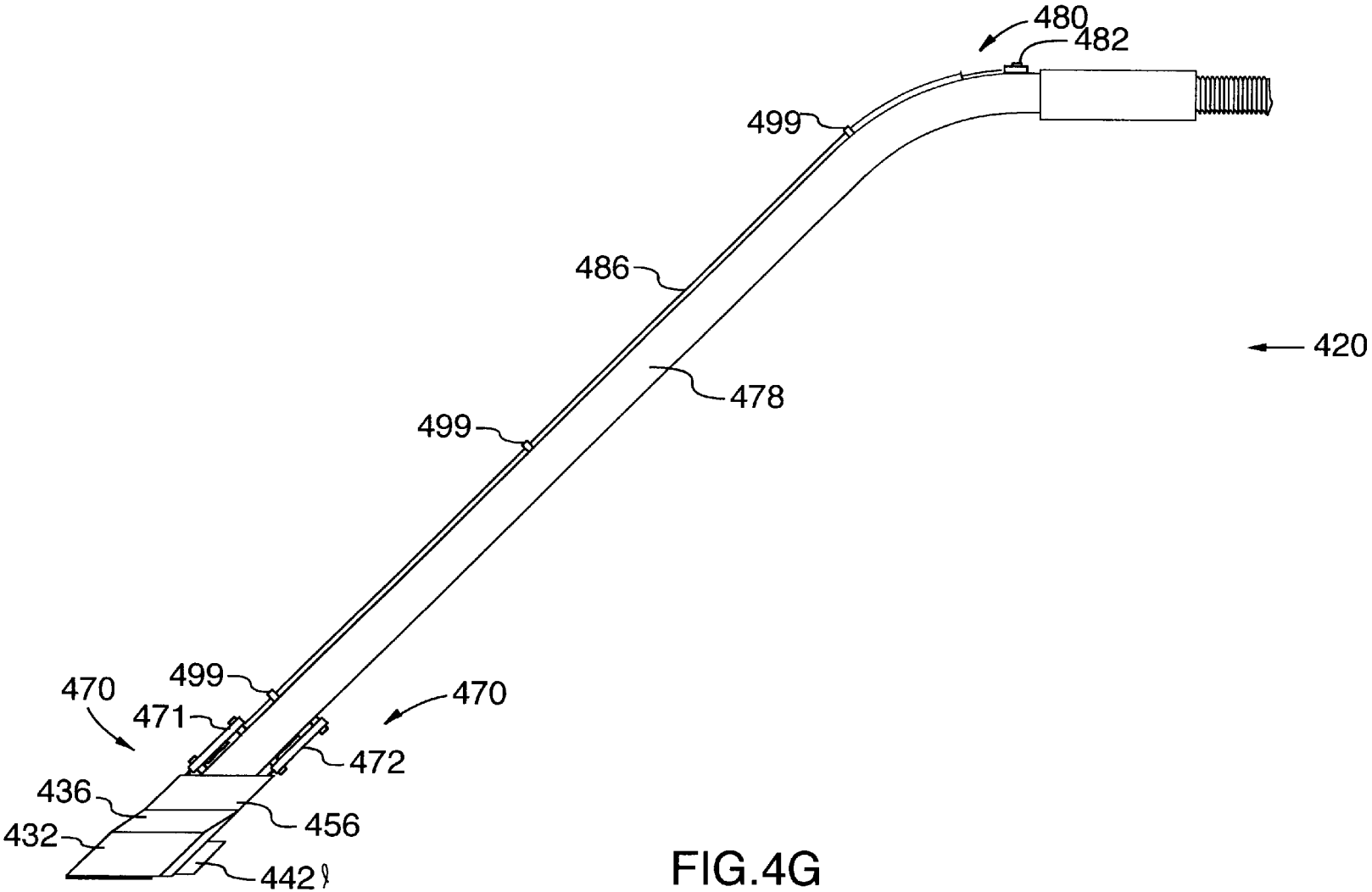
FIG. 4G is a reduced scale side elevational view of the first preferred embodiment large area surface cleaning tool of FIG. 4A.
Figure 5A:
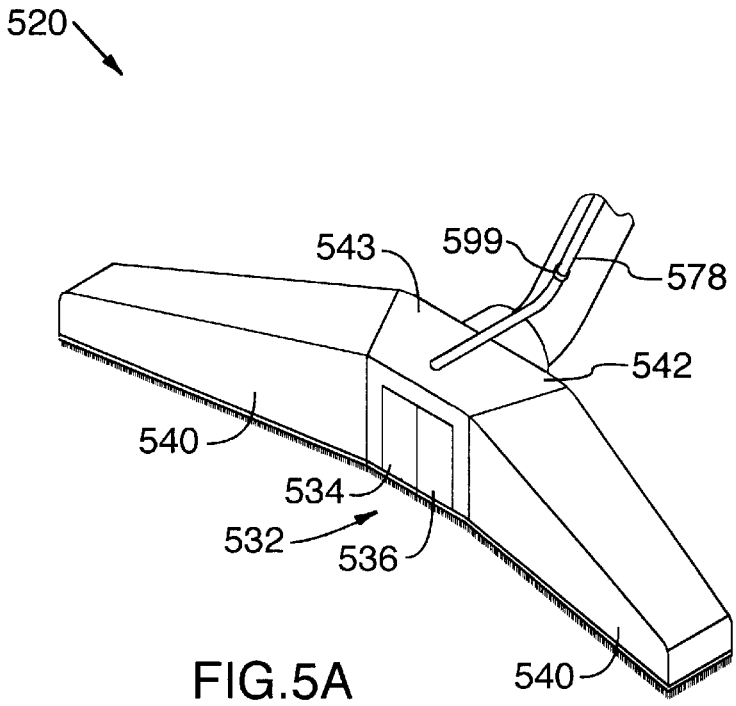
FIG. 5A is a perspective view of a fifth preferred embodiment of the large area surface cleaning tool according to the present invention, with both of the doors in a closed position.
Figure 5B:
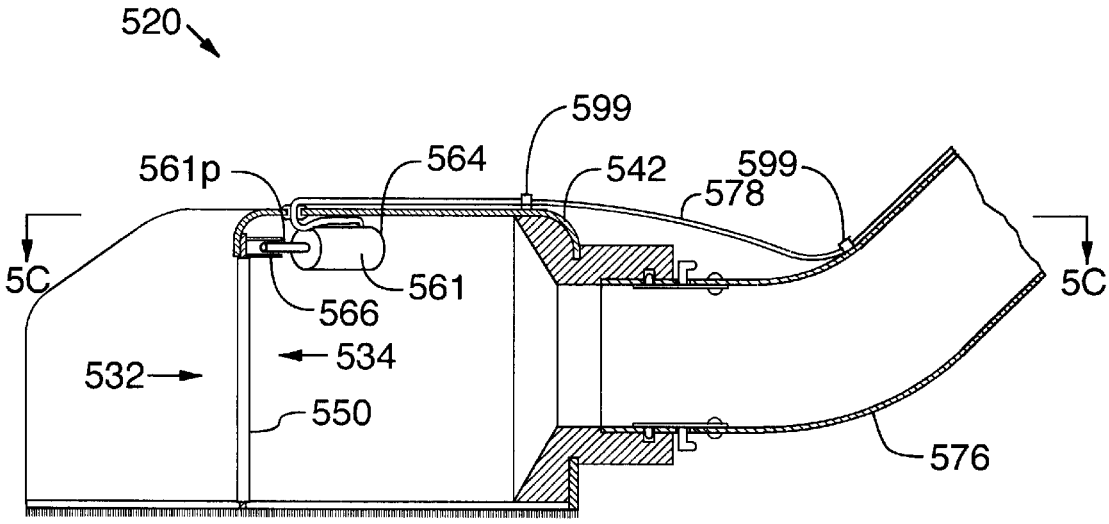
FIG. 5B is a cross-sectional side elevational view of the fifth preferred embodiment large area surface cleaning tool of FIG. 5A, taken along section line 5B—5B.
Figure 5C:
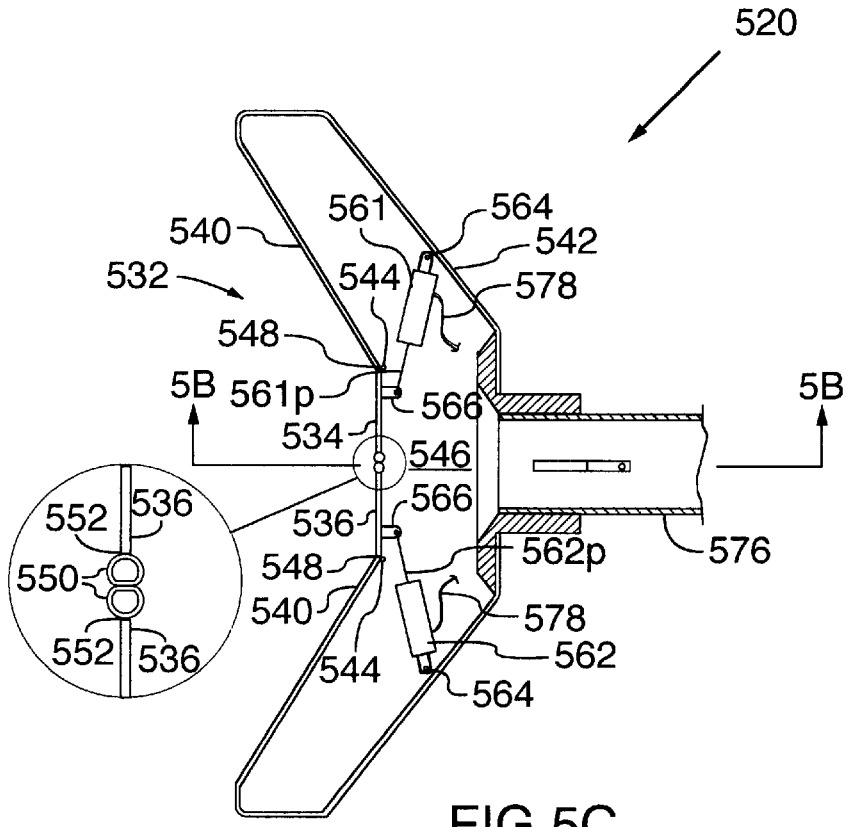
FIG. 5C is a cross-sectional top plan view of the fifth preferred embodiment large area surface cleaning tool of FIG. 5A, taken along section line 5C—5C.
Figure 5D:
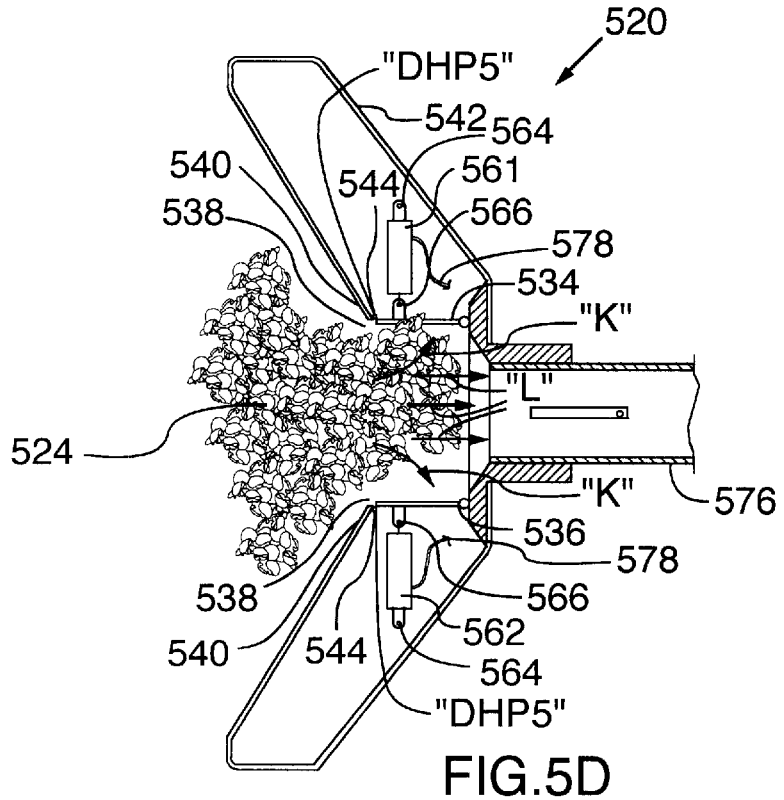
FIG. 5D is a cross-sectional side elevational view similar to FIG. 5C, but with both doors in an open position, and with debris entering into the interior of the housing.
Figure 5E:
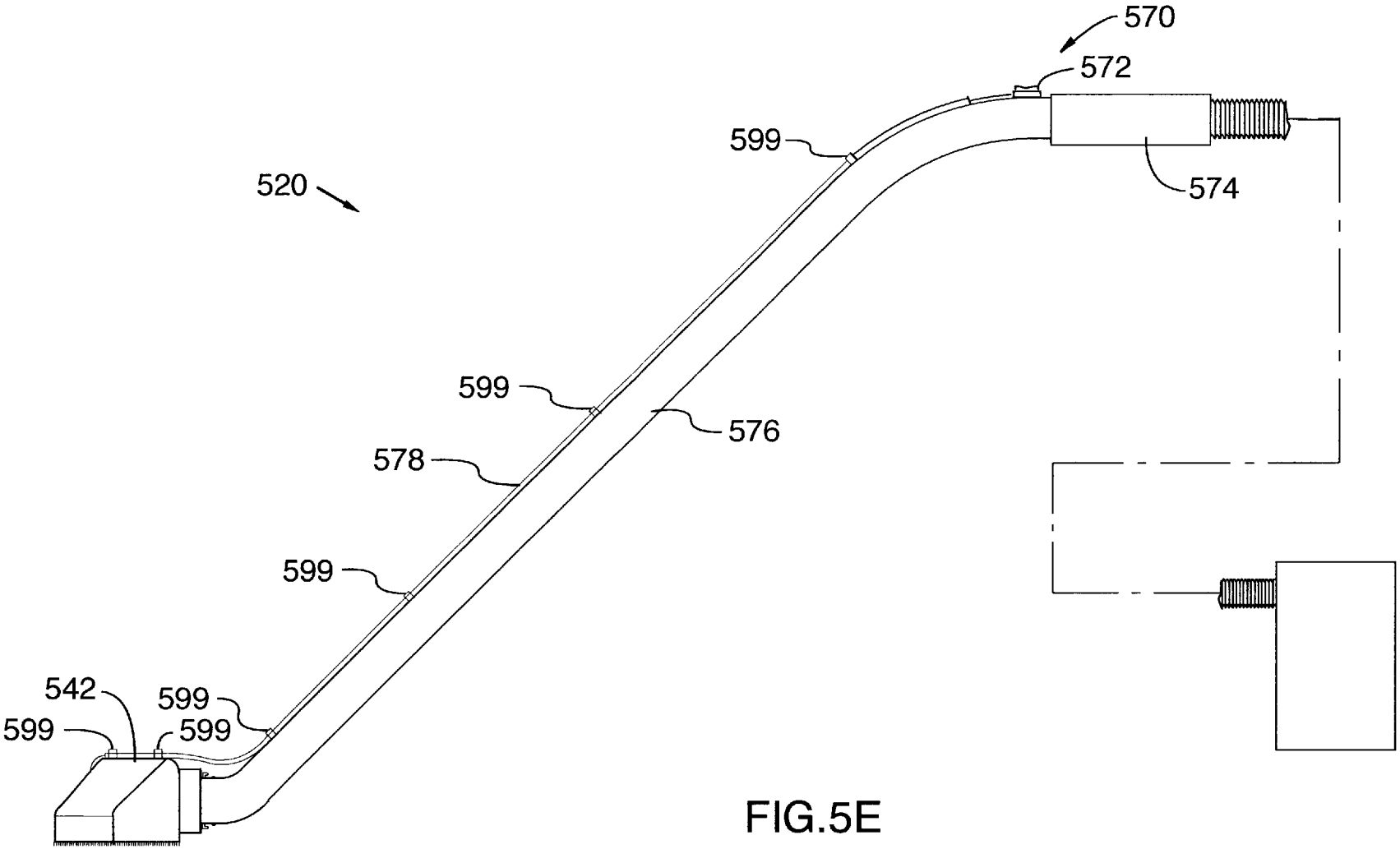
FIG. 5E is a reduced scale side elevational view of the fifth preferred embodiment large area surface cleaning tool of FIG. 5A.
Figure 6A:
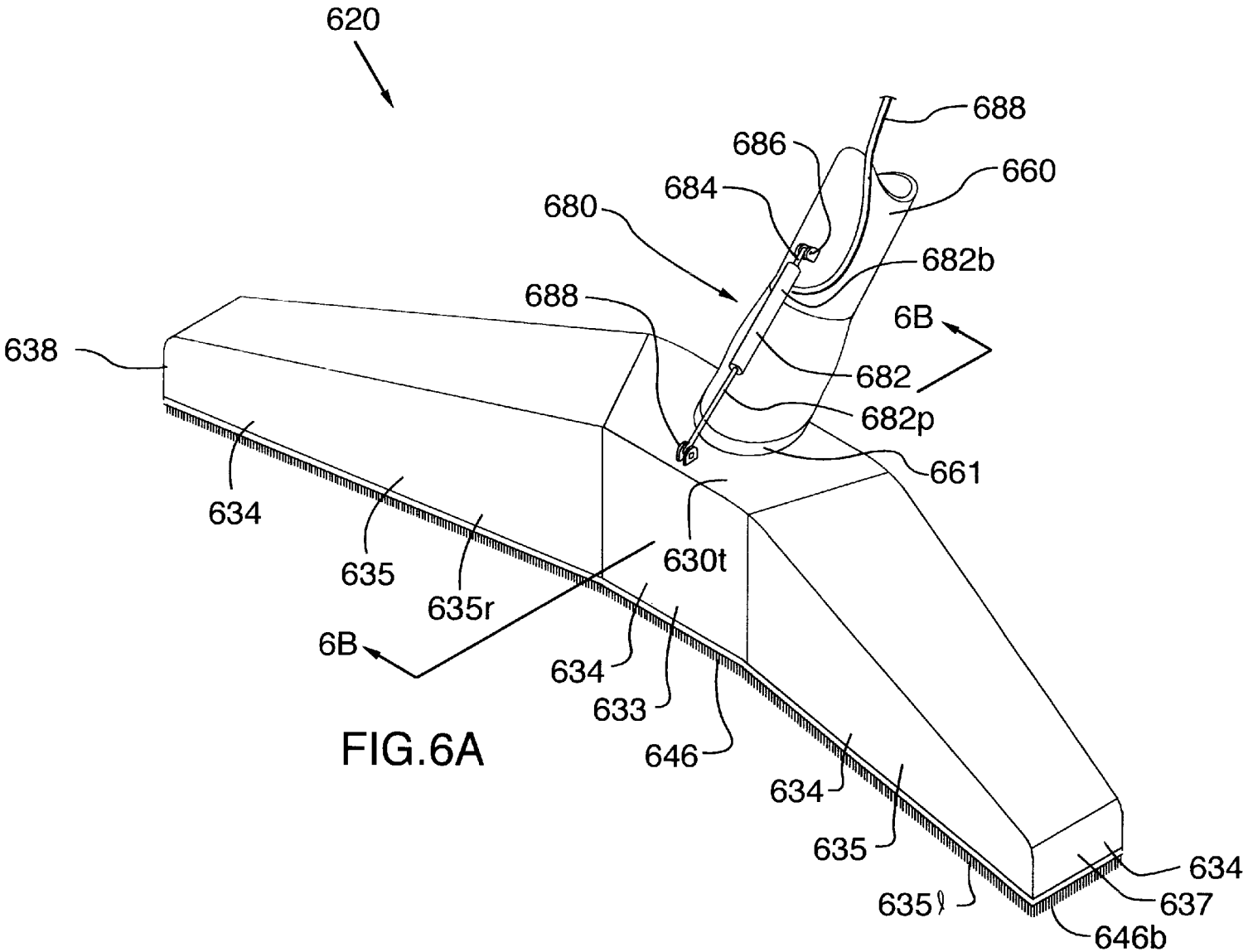
FIG. 6A is a perspective view of a sixth preferred embodiment of the large area surface cleaning tool according to the present invention, with the housing in a lowered position.

Referring to FIGS. 1A through 6D of the drawings, it will be noted that FIGS. 1A through 1F illustrate the first preferred embodiment of the hand-manipulable surface cleaning tool of the present invention, FIGS. 2A through 2F illustrate the second preferred embodiment of the hand-manipulable surface cleaning tool of the present invention, FIGS. 3A through 3D illustrate the third preferred embodiment of the hand-manipulable surface cleaning tool of the present invention, FIGS. 4A through 4G illustrate the fourth preferred embodiment of the hand-manipulable surface cleaning tool of the present invention, FIGS. 5A through 5E illustrate the fifth preferred embodiment of the hand-manipulable surface cleaning tool of the present invention, and FIGS. 6A through 60 illustrate the first preferred embodiment of the hand-manipulable surface cleaning tool of the present invention.

Reference will now be made to FIGS. 1A through 1E, which show a first preferred embodiment of the hand-manipulable surface cleaning tool of the present invention, as indicated by general reference numeral 20. The hand-manipulable surface cleaning tool 20 is for suctioning both dust and debris from a surface 22 being cleaned, such as a factory floor, or any other substantially flat surface.

Briefly, the hand-manipulable surface cleaning tool 20 comprises a housing 30 defining a substantially hollow interior 32. The housing 30 has a perimeter wall portion 34 that terminates downwardly in a surface facing peripheral bottom edge 46 that defines a suctioning bottom opening 48, that is in dust and debris transfer relation with a dust and debris outlet 49 disposed in the housing 30. The housing 30 has at least one debris passing opening 40 disposed in the perimeter wall portion 34. The debris passing opening 40 is also in dust and debris transfer relation with the dust and debris outlet 49. The dust and debris outlet 49 is connectable to a hand wand means for delivery to a vacuum source 69. In the first preferred embodiment, the hand wand means comprises an elongate wand 60 that has an inlet end 62 connected in fluid communication and in debris transfer relation via an internal airflow passageway 64 to an opposite outlet end 66 that is connected to the vacuum source 69 by a flexible suction hose 68. There is also at least one selectively movable portion, and in the first preferred embodiment a selectively movable portion 50 mounted on the housing 30. Means 80 are provided for moving the selectively movable portion 50 between its open configuration and its closed configuration, including selectively operable control means 90.

The various elements of the first preferred embodiment hand-manipulable surface cleaning tool 20 will now be described in greater detail.

In the hand-manipulable surface clean tool 20, the housing 30 includes a perimeter wall portion 34 having a front portion 35, a back portion 36, a left end portion 37, and a right end portion 38. As can be best seen in FIGS. 1A, 1B and 1E, the housing 30 is elongate from the left end portion 37 to its right end portion 38, and is preferably about one to two feet long (from the left end portion 37 to the right end portion 38), and is generally proportionate to the diameter of the suction hose 68 and the elongate wand 60, (about two to four inches high at the center), and about two to three inches from front to back, depending on the specific configuration of the housing 30.

The housing 30 is also tapered downwardly from a raised central portion 39 towards each of the left and right ends portions 37, 38, and is also tapered from front to back towards each of the left and right end portions 37,38. In this manner, the left and right end portions 37,38 can be used to vacuum into narrow passageways or corridors, and the like, such as under the bottom of shelving racks or between adjacent shelving racks.

Figure 1A:
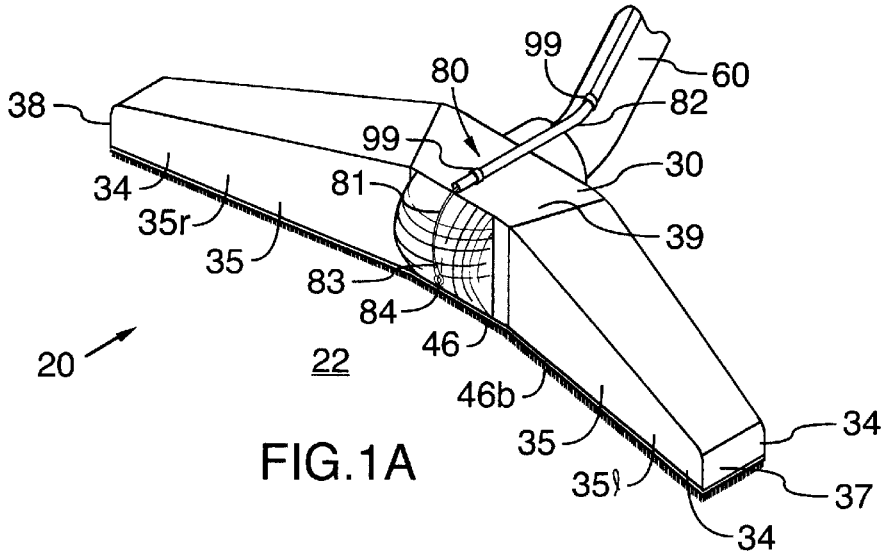
FIG. 1A is a perspective view of a first preferred embodiment of the large area surface cleaning tool according to the present invention, with the door in a closed position.
Figure 1B:
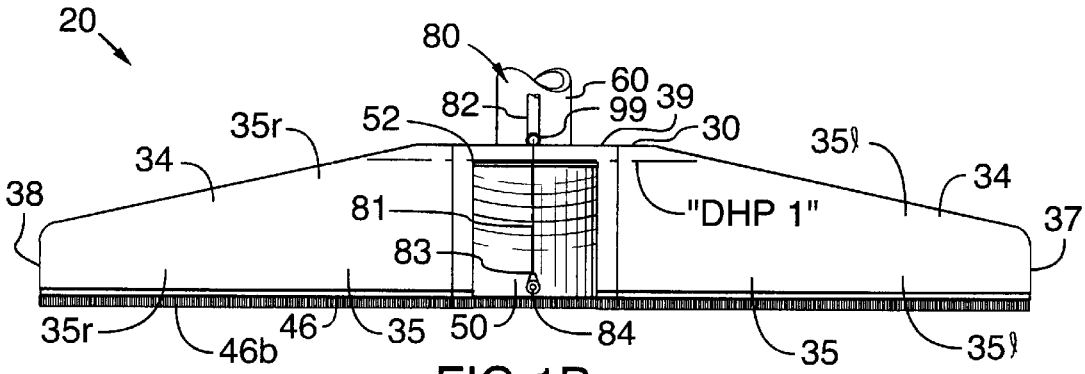
FIG. 1B is a front elevational view of the first preferred embodiment large area surface cleaning tool of FIG. 1A.

As can be best seen in FIGS. 1A and E, the front portion 35 of the perimeter wall portion 34 of the housing 30 comprises a left front portion 35*l* and a right front portion 35*r* that are each sloped rearwardly and inwardly towards a central opening 40 that is disposed in the front portion 35 between the left front portion 35*l* and the right front portion 35*r*, in debris receiving relation with respect to a surface 22 being cleaned. The rearwardly and inwardly sloping left and right front portions 35*l*, 35*r*, cause debris to be deflected towards the central opening 40 when the housing 30 of the hand-manipulable surface cleaning tool 20 is pushed forwardly along the surface 22 being cleaned.

Figure 1E:
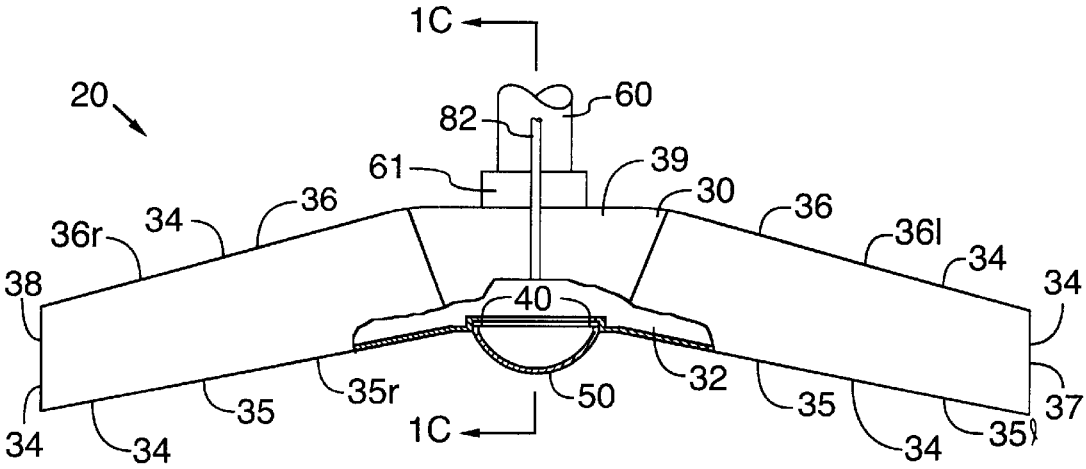
FIG. 1E is a top plan view partially cut away of the first preferred embodiment large area surface cleaning tool of FIG. 1A.

Further, as can be best seen in FIG. 1E, the back portion 36 of the perimeter wall portion 34 of the housing 30 comprises a left back portion 36*l* and a right back portion 36*r* that are each sloped rearwardly and inwardly towards the inlet end 62 of the elongate wand 60, so as to cause debris that enters the interior 32 of the housing 30 to be deflected towards the inlet end 62 of the elongate wand 60 when the housing 30 of the hand-manipulable surface cleaning tool 20 is pushed forwardly along the surface 22 being cleaned.

Figure 1C:
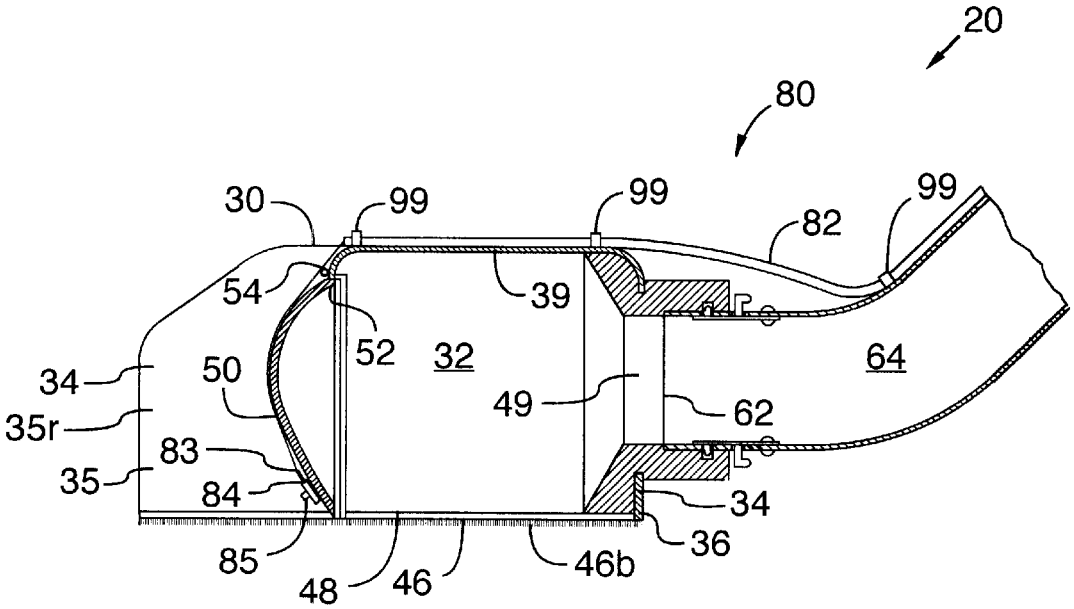
FIG. 1C is a cross-sectional side elevational view of the first preferred embodiment large area surface cleaning tool of FIG. 1A taken along section line 1C—1C.
Figure 1D:
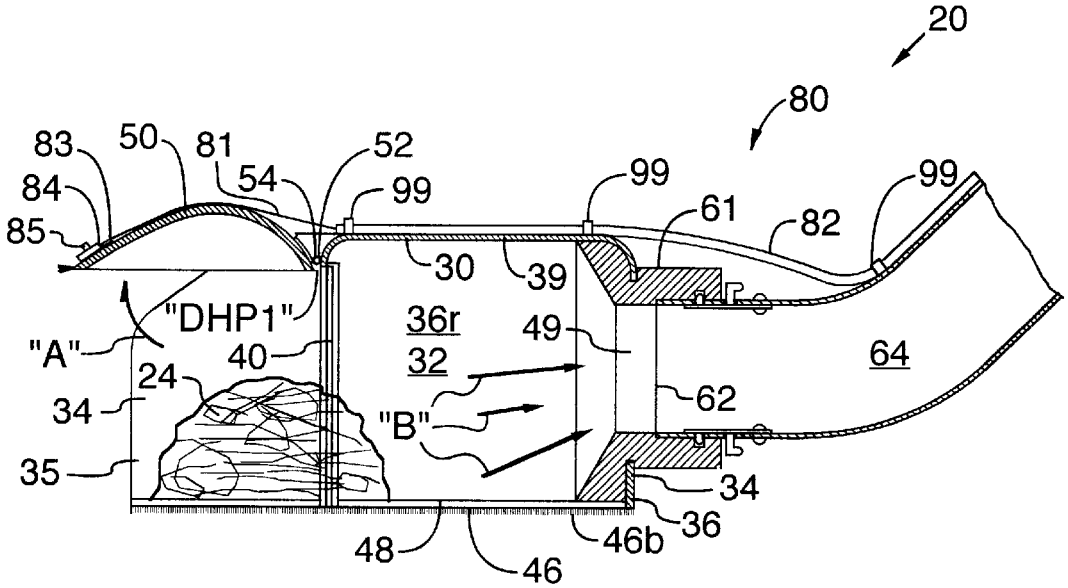
FIG. 1D is a cross-sectional side elevational view similar to FIG. 1C, but with the door in an open position, and with debris entering into the interior of the housing.

The substantially hollow interior 32 of the housing 30 of the hand-manipulable surface cleaning tool 20 can best be seen in FIGS. 1C, 1D and 1E. The perimeter wall portion 34 of the housing 30 terminates downwardly in the substantially straight surface facing peripheral bottom edge 46. The surface facing peripheral bottom edge 46 defines, as aforesaid, the suctioning bottom opening 48 that is continuous with the interior 32 of the housing 30. In use, preferably at least a portion of the surface facing peripheral bottom edge 46 is in contact with the surface 22 being cleaned, in order to maintain the housing 30 in dust suctioning relation with respect to the surface 22 being cleaned. Alternatively, the surface facing peripheral bottom edge 46 can be maintained in close proximity to the surface 22 without contacting it by the use of support mechanisms such as wheels or skid plates.

In the first preferred embodiment, as illustrated, the surface facing peripheral bottom edge 46 comprises numerous downwardly projecting bristles 46*b* that permit the housing 30 of the hand-manipulable surface cleaning tool 20 to slide along a smooth floor without doing damage to either the floor or to the surface facing peripheral bottom edge 46 of the housing 30. The bristles 46*b* also provide an airflow passageway between the surface 22 being cleaned and the remainder of the housing 30, which airflow passageway has a relatively small cross-sectional area that is preferably less than or even approximately the same as the same cross-sectional area of the internal airflow passageway 64 of the elongate wand 60, so as to permit a suitable high speed airflow therethrough, and subsequently into the housing 30 through the suctioning bottom opening 48. In this manner, air and dust can enter the interior 32 of the housing 30, thus maintaining the housing 30 in dust suctioning relation with respect to the surface 22 being cleaned, as aforesaid. Alternatively, rubber squeegees can be used in place of the bristles 46*b* for applications where water is to be suctioned. Alternatively, the surface facing peripheral bottom edge 46 may be substantially straight or may be ridged.

The selectively movable portion 50 of the housing 30 permits access by debris to the interior 32 of the housing 30, as can be best seen in FIG. 1D. In the first preferred embodiment, as illustrated, the selectively movable portion 50 comprises a first door member 50 mounted on the front portion of the housing 30 by means of a door hinge 52 having a door hinge pivot axis "DHP1", and permits access to the interior 32 of the housing 30, as aforesaid, through the debris passing opening 40. As shown in FIGS. 1A through 1F, the door hinge pivot axis "DHP1" is oriented substantially horizontally at the top of the first door member 50. In this manner, the first door member 50 is movable from a closed configuration or position, as is best seen in FIGS. 1A through 1C, 1E and 1F, to an open configuration or position, as indicated by arrow "A" in FIG. 1D, thereby to permit access by debris 24 through the debris passing opening 40 to the interior 32 of the housing 30, as indicated by arrows "B". In the closed position of the first door member 50, debris is precluded from passing through the debris passing opening 50. A coil spring 54 is preferably integrated within the door hinge 52 so as to spring bias the first door member 50 to its closed position. Also, as can be best seen in FIGS. 1C and 1D, the first door member 50 is shaped convexly to the exterior of the housing 30 so as to not propel debris forwardly when the first door member 50 opens.

The debris passing opening 40 is adjacent the surface facing peripheral bottom edge 46, and preferably the debris passing opening 40 extends upwardly from the surface facing peripheral bottom edge 46, so as to most readily accommodate the passage of debris therethrough. Alternatively, for the purpose of structural strength, a small reinforcing bar or the like may extend across the bottom of the opening so as to join the rearwardly and inwardly sloped left and right front portions 35*l*, 35*r*; however, this may be undesirable since debris entering the interior 32 of the housing 30 would be partially blocked.

Figure 1F:
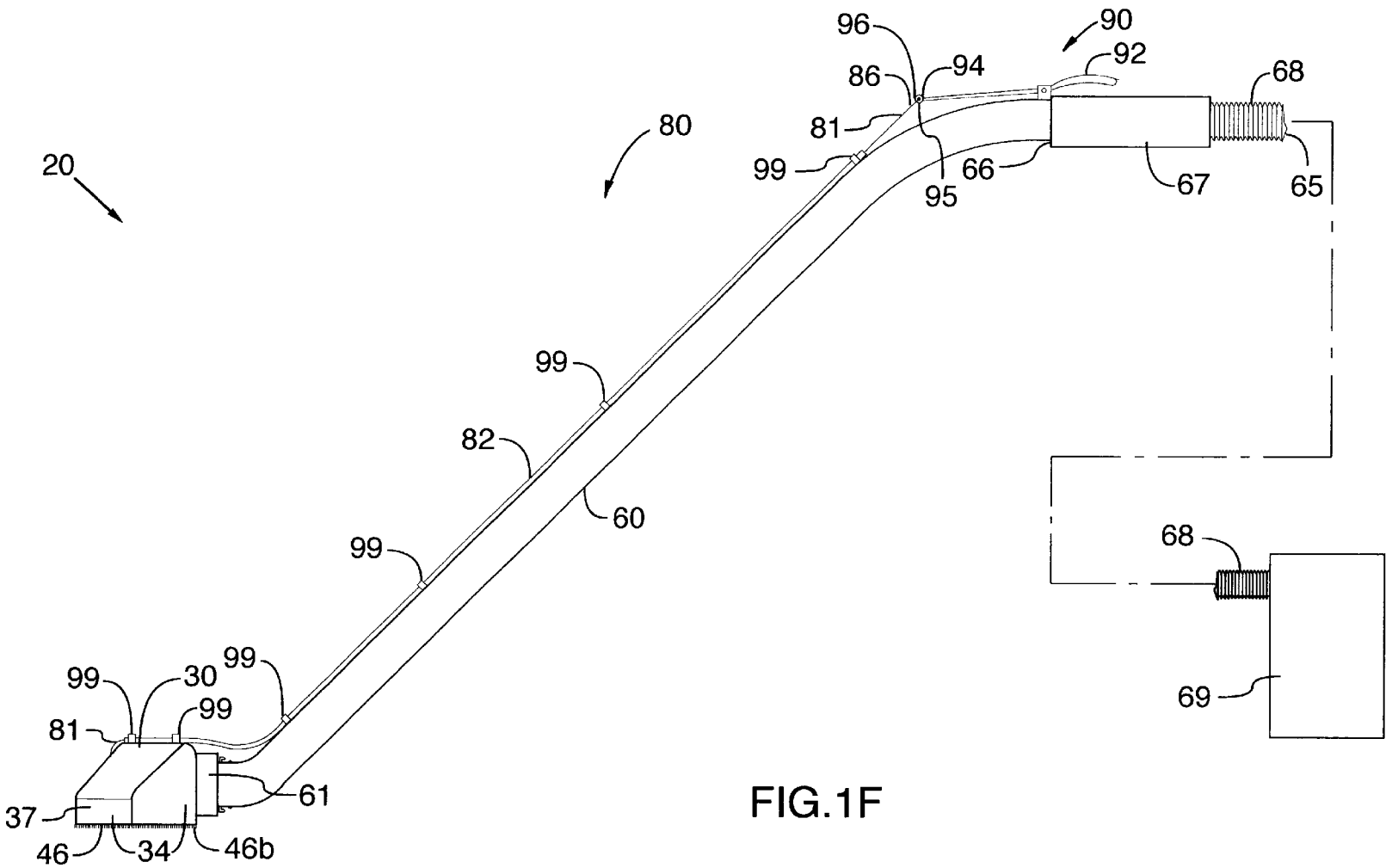
FIG. 1F is a reduced scale side elevational view of the first preferred embodiment large area surface cleaning tool of FIG 1A.

As is best seen in FIG. 1F, the elongate wand 60 is interposed between the housing 30 and the flexible suction hose 68 to permit manual manipulation of the hand-manipulable surface cleaning tool 20. The flexible suction hose 68 also has an airflow passageway 65 that is connected in fluid communication and debris depositing relation to the vacuum source 69. The elongate wand 60 is mounted at its inlet end 62 via a wand connector member 61 to the housing 30 such that the inlet end 62 is disposed in dust and debris suctioning relation with respect to the substantially hollow interior 32 of the housing 30, as can be best seen in FIGS. 1C and 1D. The inlet end 62 of the elongate wand 60 is connected in fluid communication and in debris transfer relation via the internal airflow passageway 64 to the opposite outlet end 66 disposed exteriorly to the housing 30, as aforesaid, at a handle 67 that joins the outlet end 66 to the flexible suction hose 68 of the vacuum source 69. The outlet end 66 is thereby also in fluid communication and in debris transfer relation with the vacuum source 69, to thereby permit access by debris through the elongate wand 60 and into the vacuum source 69. The vacuum source 69 comprises both a source of vacuum and a debris receptacle, as is well known in the art. It is also well known that the vacuum source (impeller, pump, etc.) although is commonly beyond the receptacle can also precede the receptacle and thereby have debris flow through it. Preferably, the elongate wand 60 is made from a rigid metal or plastic material, such as stainless steel, aluminum, UHMW (ultra-high molecular weight) plastic, or any other suitable material, as is well known in the industry.

There is also means 80 for moving the selectively movable portion 50, or in other words the first door member 50, from its closed position, as best seen in FIGS. 1A through 1C, 1E and 1K to its open position, as best seen in FIG. 1D, against the biasing of the coil spring 54, to thereby permit access by debris to the interior 32 of the housing 30, and to thereby permit access by debris through the elongate wand 60 and into the vacuum source 69. The means 80 for moving the selectively movable portion 50 comprises a manually operable cable 81 disposed within a sheath 82 and secured at its lower end 83 to the first door 50 by means of a threaded fastener 85 extending through an "eye" connector 84 crimped onto the lower end 83 of the cable 81 and fastened to the first door 50 by the threaded fastener 85. The cable 81 is secured at its upper end 86 to the selectively operable control means 90 for controlling the means 80 for moving the selectively movable portion 50.

As can be best seen in FIG. 1F, the selectively operable control means 90 comprises a thumb operated lever 92 pivotally mounted onto the elongate wand 60 adjacent the outlet end 66 and adjacent the handle 67. The cable 81 is secured at its upper end 86 to one end 94 of the thumb operated lever 92 by passing through an aperture 95 and being secured back onto itself by means of a connector 96 crimped onto the upper end 86 of the cable 81. The cable 81 is protected along most of its length by the sheath 82 that is secured to the elongate wand 60 and the housing 30 by a plurality of "U"-shaped connectors 99 threadibly fastened to the elongate wand 60 and the housing 30. It is to be clearly understood that various other means may also be used to operate the door 50, such as an electric solenoid, among others, and that this patent is in no way limited in its scope by the selection of the manually operable cable 81 and lever 92 in this first preferred embodiment.

Reference will now be made to FIGS. 2A through 2F, which show a second preferred embodiment of the hand-manipulable surface cleaning tool of the present invention, as indicated by general reference numeral 220. The hand-manipulable surface cleaning tool 220 is similar to the first preferred embodiment hand-manipulable surface cleaning tool 20, except that the opening 230 is disposed in the back portion 232 of the perimeter wall portion 234 of the housing 236 and the selectively movable portion 238 of the housing 236, specifically the first door 238, is mounted on the back portion 232 of the perimeter wall portion 234 of the housing 236 by means of a door hinge 240 having a door hinge pivot axis "DHP2". In this manner, the first door 238 is movable from a closed position, as is best seen in FIGS. 2A through 2C, 2E and 2F, to an open position, as indicated by arrow "C" in FIG. 2D, thereby to permit access by debris 224 to the interior 242 of the housing 236, as indicated by arrows "D", through the debris passing opening 230.

Figure 2A:
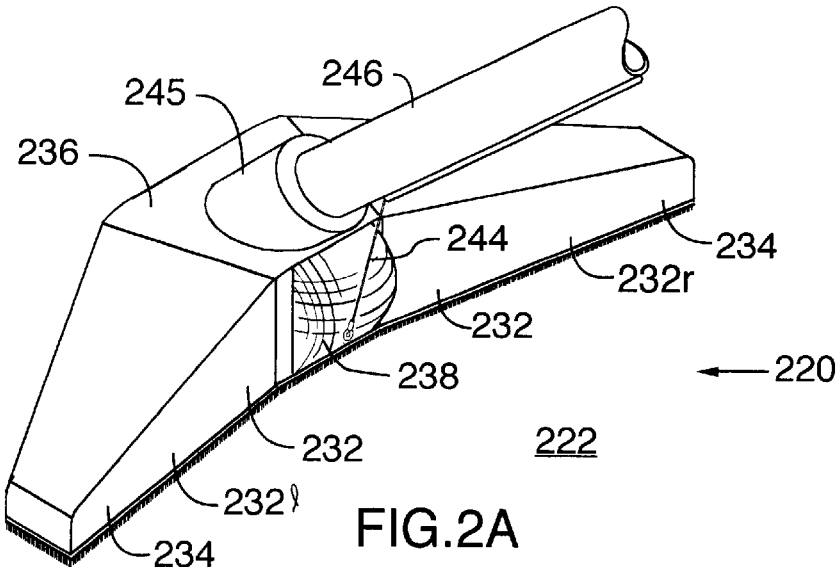
FIG. 2A is a perspective view of a second preferred embodiment of the large area surface cleaning tool according to the present invention, with the door in a closed position.
Figure 2B:
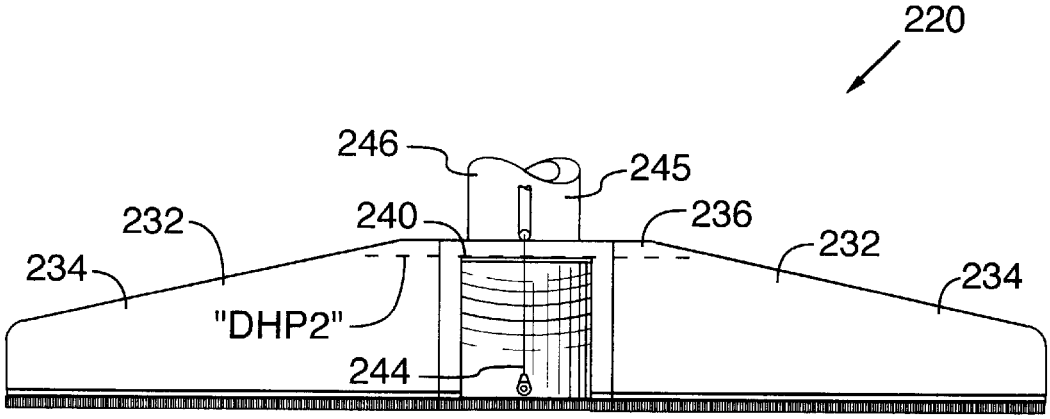
FIG. 2B is a front elevational view of the second preferred embodiment large area surface cleaning tool of FIG. 2A.
Figure 2E:
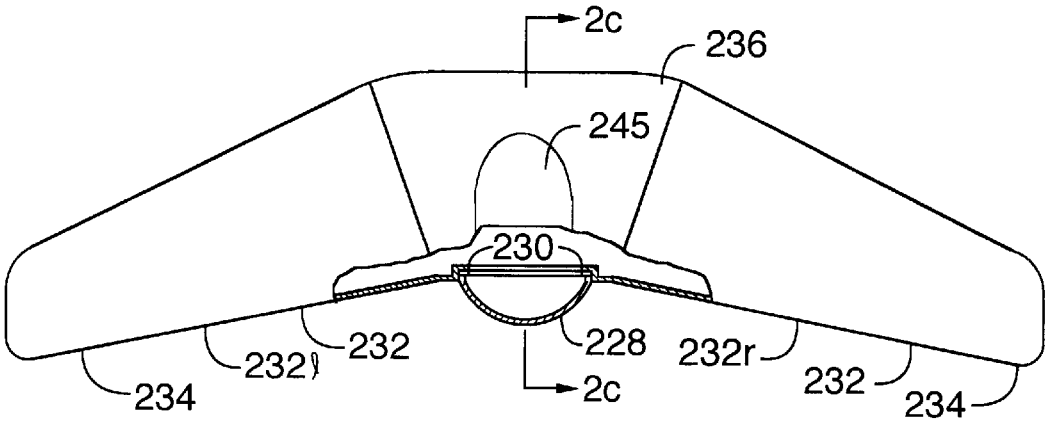
FIG. 2E is a top plan view partially cut away of the second preferred embodiment large area surface cleaning tool of FIG. 2A.
Figure 2C:
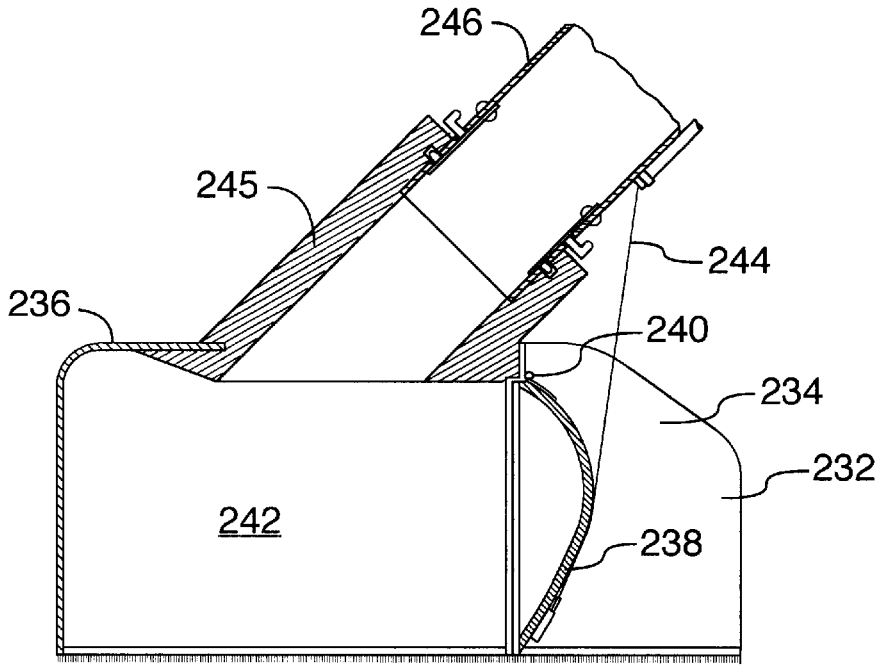
FIG. 2C is a cross-sectional side elevational view of the second preferred embodiment large area surface cleaning tool of FIG. 2A, taken along section line 2C—2C.
Figure 2D:
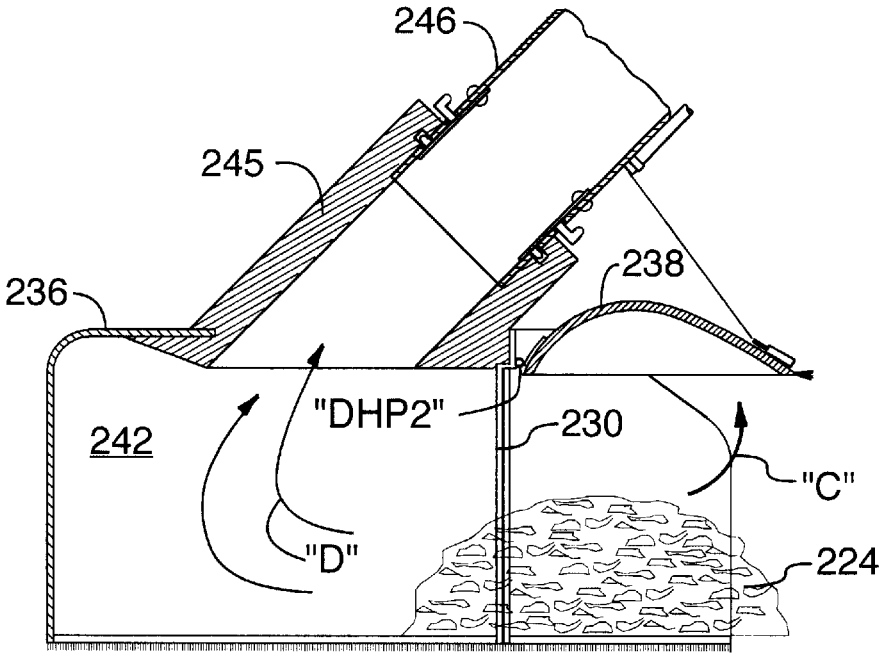
FIG. 2D is a cross-sectional side elevational view similar to FIG. 2C, but with the door in an open position, and with debris entering into the interior of the housing.

Further, as can be best seen in FIGS. 2A and 2E, the back portion 232 of the perimeter wall portion 234 of the housing 236 comprises left and right back portions 232*l*, 232*r* that are each sloped forwardly and inwardly towards the central opening 230 that is disposed in the back portion 232 between the left and right back portions 232*l*, 232*r*, in debris receiving relation with respect to a surface 222 being cleaned.

Figure 2F:
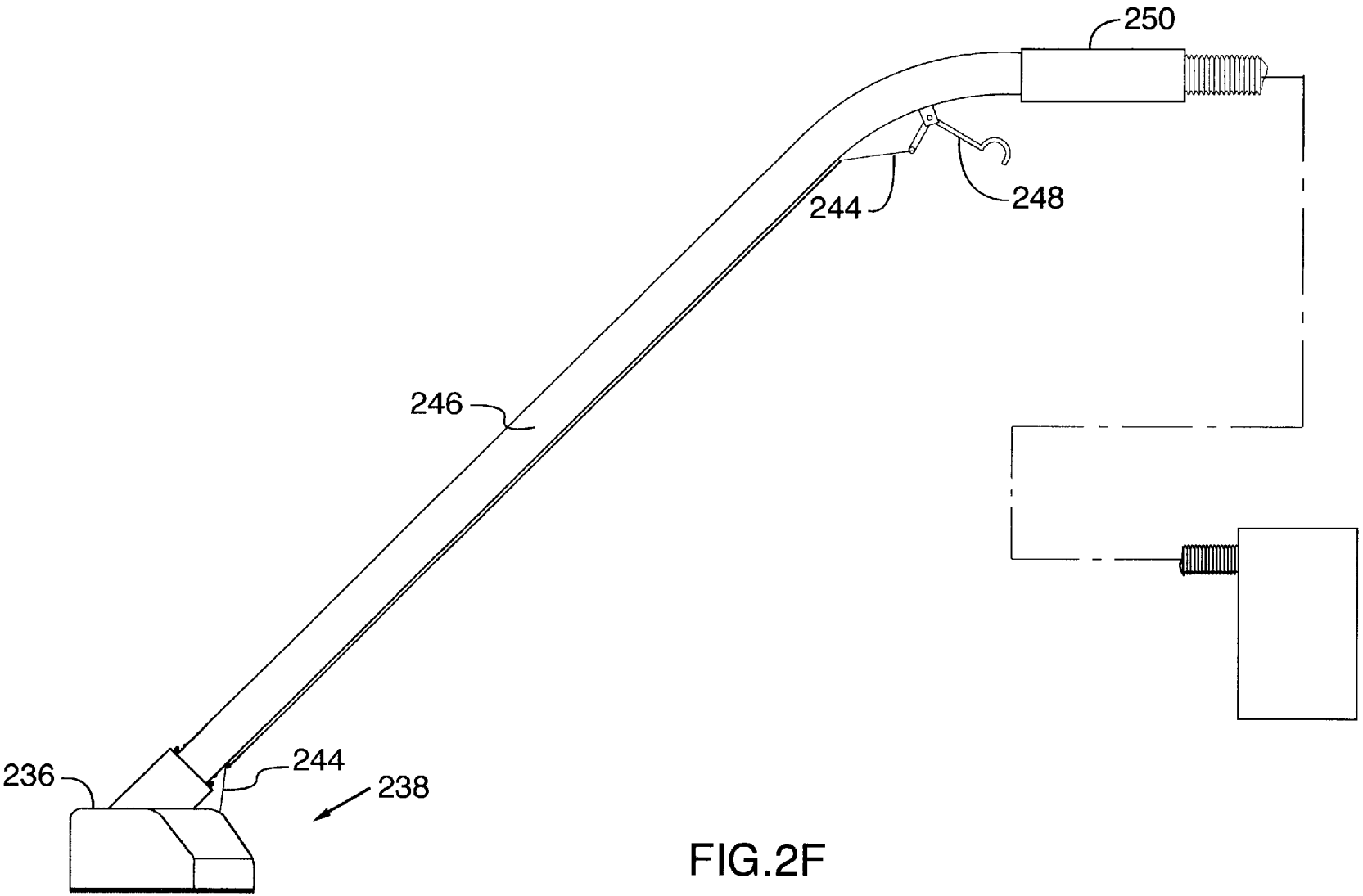
FIG. 2F is a reduced scale side elevational view of the second preferred embodiment large area surface cleaning tool of FIG. 2A.

Also, the elongate wand 246 is mounted to the housing 236 by a connector 245 and the manually operable cable 244 is mounted on the underside of the elongate wand 246, and, as can be best seen in FIGS. 2F, the selectively operable control means comprises a finger operated lever member 248 pivotally mounted onto the elongate wand 246 adjacent the handle 250.

Reference will now be made to FIGS. 3A through 3E, which show a third preferred embodiment of the hand-manipulable surface cleaning tool 320 of the present invention, as indicated by general reference numeral 320. The hand-manipulable surface cleaning tool 320 is for suctioning both dust and debris from a surface 322 being cleaned, such as a factory floor, or any other substantially flat surface.

Briefly, the hand-manipulable surface cleaning tool 320 comprises a housing 330 defining a substantially hollow interior 332. The housing 330 has a perimeter wall portion 334 that terminates downwardly in a surface facing peripheral bottom edge 346 that defines a suctioning bottom opening 348, and a selectively movable portion 350. An elongate wand 360 has an inlet end 362 connected in fluid communication and in debris transfer relation via an internal airflow passageway 364 to an opposite outlet end 366 that is connected to a vacuum source 369 by a flexible suction hose 368. Means 380 are provided for moving the selectively movable portion 350. Selectively operable control means 390 are also provided.

The various elements of hand-manipulable surface cleaning tool 320 will now be described in greater detail.

In the hand-manipulable surface clean tool 320 the housing 330 includes a perimeter wall portion 334 having a front portion 335, a back portion 336, a left end portion 337, and a right end portion 338. As can be best seen in FIGS. 3A, 3B the housing 330 is elongate from its left end portion 337 to its right end portion 338, and is preferably about one to two feet long (from the left end portion 337 to the right end portion 338), about two to four inches high, and about two to three inches from front to back, depending on the specific configuration of the housing 330.

Figure 3A:
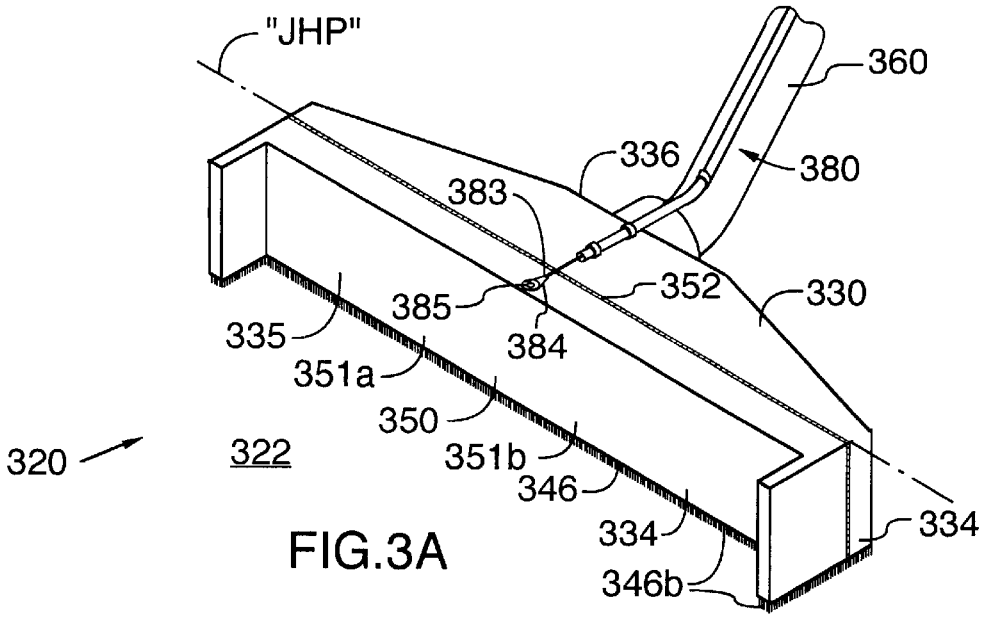
FIG. 3A is a perspective view of a third preferred embodiment of the large area surface cleaning tool according to the present invention, with the door in a closed position.
Figure 3D:
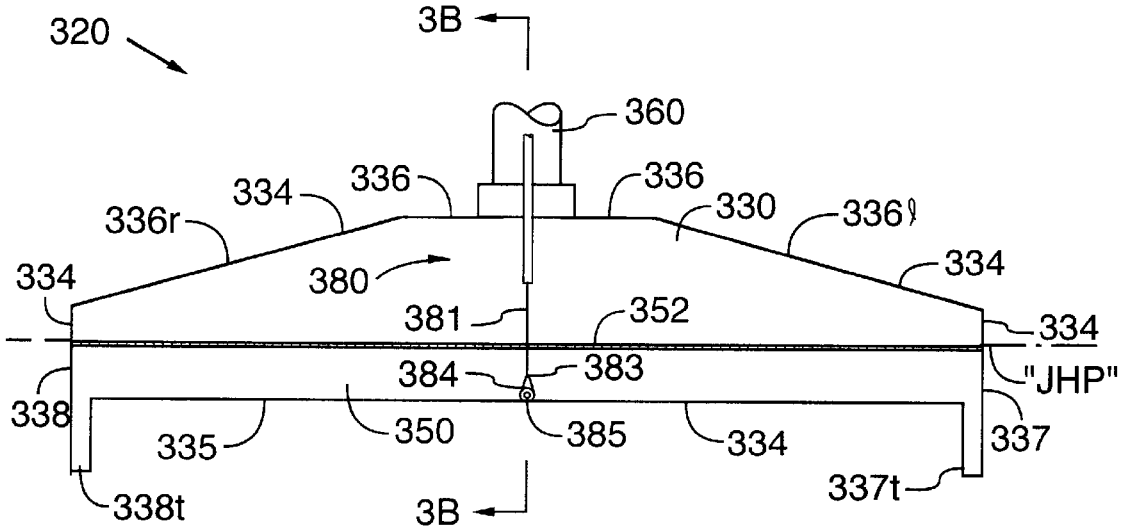
FIG. 3D is a top plan view of the third preferred embodiment large area surface cleaning tool of FIG. 3A.

As can be best seen in FIGS. 3A and 3D, the front portion 335 of the perimeter wall portion 334 of the housing 330 comprises left and right forwardly projecting tabs 337*t*, 338*t* disposed one adjacent each end of the left and right end portions 337, 338 of the perimeter wall portion 334. The left and right forwardly projecting tabs 337*t*, 338*t* each retain debris at the front portion 335 of the perimeter wall portion 334 of the housing 330 and preclude the retained debris from escaping from the area in front of the front portion 335, when the housing 330 of the hand-manipulable surface cleaning tool 320 is pushed forwardly along the surface 322 being cleaned.

Further, as can be best seen in FIG. 3D, the back portion 336 of the perimeter wall portion 334 of the housing 330 comprises left and right portions 336*l*, 336*r* that are each sloped rearwardly and inwardly towards the inlet end 362 of the elongate wand 360, so as to cause debris that enters the interior of the housing 330 to be deflected towards the inlet end 362 of the elongate wand 360 when the housing 330 of the hand-manipulable surface cleaning tool 320 is pushed forwardly along the surface 322 being cleaned.

Figure 3B:
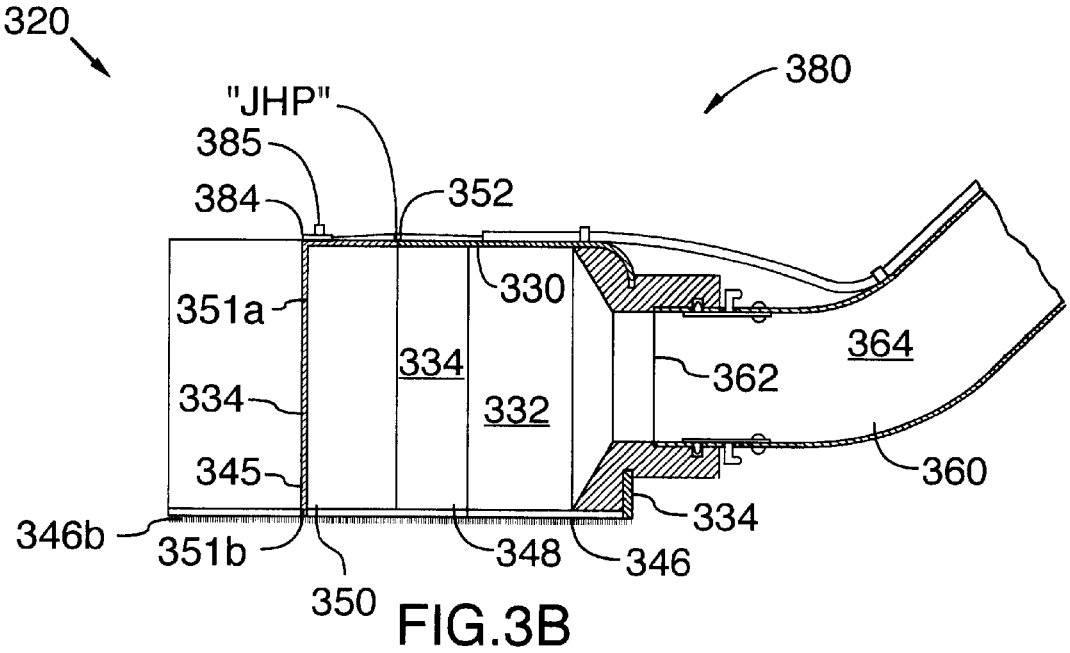
FIG. 3B is a cross-sectional side elevational view of the third preferred embodiment large area surface cleaning tool of FIG. 3A, taken along section line 3B—3B.
Figure 3C:
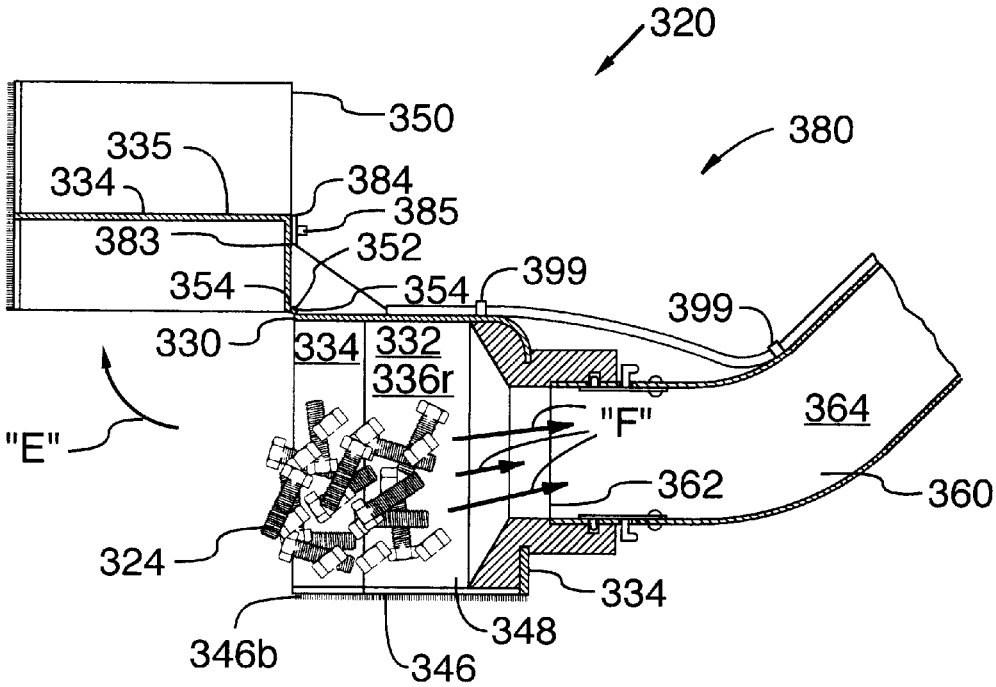
FIG. 3C is a cross-sectional side elevational view similar to FIG. 3B, but with the door in an open position, and with debris entering into the interior of the housing.

The substantially hollow interior 332 of the housing 330 of the hand-manipulable surface cleaning tool 320 can best be seen in FIGS. 3B and 3C. The perimeter wall portion 334 of the housing 330 terminates downwardly in the substantially straight surface facing peripheral bottom edge 346. The surface facing peripheral bottom edge 346 defines, as aforesaid, the suctioning bottom opening 34 that is continuous with the interior of the housing 330. In use, at least a portion of the surface facing peripheral bottom edge 346 is in contact with the surface 322 being cleaned, in order to maintain the housing 330 in dust suctioning relation with respect to the surface 322 being cleaned. Alternatively, the surface facing peripheral bottom edge 346 can be maintained in close proximity to the surface 322 without contacting it by use of support mechanisms such as wheels or skid plates.

In the third preferred embodiment, as illustrated, the surface facing peripheral bottom edge 346 comprises numerous downwardly projecting bristles 346*b* that permit the housing 330 of the hand-manipulable surface cleaning tool 320 to slide along a smooth floor without doing damage to either the floor or the surface facing peripheral bottom edge 346 of the housing 330. The bristles also provide an airflow passageway between the surface 322 being cleaned and the remainder of the housing 330, which airflow passageway has a relatively small cross-sectional area, essentially the same cross-sectional area of the internal airflow passageway of the elongate wand 360, so as to permit a suitable high speed airflow and subsequently into the housing 330 through the suctioning bottom opening 348. In this manner, air and dust can enter the interior of the housing 330, thus maintaining the housing 330 in dust suctioning relation with respect to the surface 322 being cleaned, as aforesaid. Alternatively, rubber squeegees can be used in place of the bristles for applications where water is to be suctioned.

The selectively movable portion 350 of the housing 330 permits access by debris to the interior of the housing 330, as can be best seen in FIG. 3C. In the third preferred embodiment, as illustrated, the selectively movable portion 350 comprises a jaw member 350 that includes a jaw section 351*a* of the perimeter wall portion 334 and a jaw section 351*b* of the surface facing peripheral bottom edge 346. The jaw member 350 is mounted on the top portion of the housing 330 by means of a jaw hinge 352 having a jaw hinge pivot axis "JHP", for movement between a closed position whereat the jaw section 351*b* of the surface facing peripheral bottom edge 346 is in substantial alignment with the remainder of the surface facing peripheral bottom edge 346, so as to, in use, contact a surface 322 being cleaned, and an open position whereat the jaw section 351*b* of the surface facing peripheral bottom edge 346 is removed from the substantial alignment with the remainder of the surface facing peripheral bottom edge 346, thereby to permit the access by debris to the interior of the housing 330.

As best seen in FIGS. 3A through 3D, the jaw hinge pivot axis "JHP" is oriented substantially horizontally and is disposed on top of the housing 330. In this manner, the jaw member 350 is movable upwardly from a closed position, as best seen in FIGS. 3A, 3B and 3D, to an open position, as indicated by arrow "E" in FIG. 3C, such that the jaw section 351*b* of the surface facing peripheral bottom edge 346 is disposed generally above the remainder of the surface facing peripheral bottom edge 346, and thereby to permit access by debris 324 to the interior of the housing 330, as indicated by arrows "F". A coil spring 354 is preferably integrated within the jaw hinge 352 so as to spring bias the jaw member 350 to its closed position.

Figure 3E:
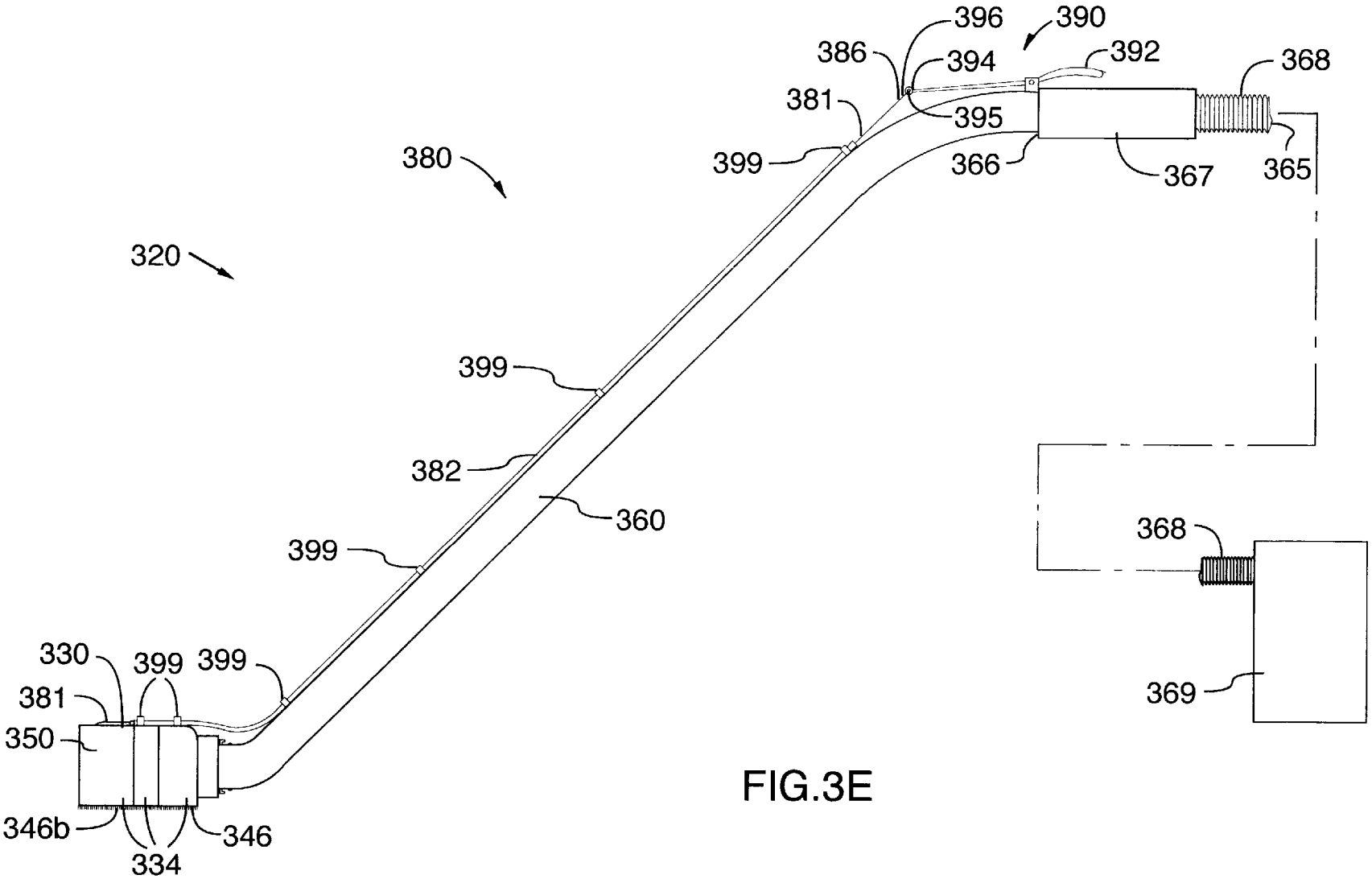
FIG. 3E is a reduced scale side elevational view of the third preferred embodiment large area surface cleaning tool of FIG. 3A.

As can be best seen in FIG. 3E, the elongate wand 360 in the third preferred embodiment is interposed between the housing 330 and the flexible suction hose 368 of the vacuum source 369, to permit manual manipulation of the hand-manipulable surface cleaning tool 320. The flexible suction hose 368 also has an airflow passageway 365 that is connected in fluid communication and debris depositing relation to the vacuum source 369. The elongate wand 360 has an inlet end 362 disposed in dust and debris suctioning relation with respect to the substantially hollow interior 332 of the housing 330, as can be best seen in FIGS. 3B and 3C. The inlet end 362 of the elongate wand 360 is connected in fluid communication and in debris transfer relation via the internal airflow passageway 364 to the opposite outlet end 366 disposed exteriorly to the housing 330, as aforesaid, at a handle 267 that joins the outlet end to the flexible suction hose 368 of the vacuum source 369. The outlet end is thereby also in fluid communication and in debris transfer relation with a vacuum source 369 that comprises both a source of vacuum and a debris receptacle, as is well known in the art. It is also well know that the vacuum source (impeller, pump, etc.) although is commonly beyond the receptacle can also precede the receptacle and thereby have debris flow through it. Preferably, the elongate wand 360 is made from a rigid metal material, such as stainless steel, aluminum, UHMW (ultra-high molecular weight) plastic, or any other suitable material, as is well known in the industry.

There is also means for moving the selectively movable portion 350, or in other words the jaw member 350, from its closed position, as best seen in FIGS. 3A, 3B, 3D and 3E, to an open position, as best seen in FIG. 3C, against the biassing of the coil spring 354, to thereby permit access by debris to the interior of the housing 330, and to thereby permit access by debris through the elongate wand 360 and into the vacuum source 369. The means for moving the selectively movable portion 350 comprises a manually operable cable 381 disposed within a sheath 382 secured at its lower end 383 to the jaw 350 by means of a threaded fastener 385 extending through an "eye" connector 384 crimped onto the lower end of the cable and fastened to the jaw 350 by the threaded fastener 385. The cable 381 is secured at its upper end 386 to the selectively operable control means for controlling the means for moving the selectively movable portion 350. As can be best seen in FIG. 3E, the selectively operable control means comprises a thumb operated lever 392 pivotally mounted onto the elongate wand 360 adjacent the outlet end and adjacent the handle 367. The cable 381 is secured at its upper end 386 to one end 394 of the thumb operated lever 392 by passing through an aperture 395 and being secured back onto itself means of a connector 396 crimped onto the upper end 386 of the cable 381. The cable 381 is protected along most of its length by the sheath 382 secured to the elongate wand by a plurality of "U"-shaped connectors 399 threadibly fastened to the elongate wand 360 and the housing 330. It is to be clearly understood that various other means may also be used to operate the door 350, such as an electric solenoid, among others, and that this patent is in no way limited in its scope by the selection of the manually operable cable 381 and lever 392 in this third preferred embodiment.

Reference will now be made to FIGS. 4A through 4F, which show a fourth preferred embodiment of the hand-manipulable surface cleaning tool of the present invention, as indicated by general reference numeral 420. The hand-manipulable surface cleaning tool 420 is similar to the first preferred embodiment hand-manipulable surface cleaning tool 20, except that there is a first opening 430 disposed in the front portion 432 of the perimeter wall portion 434 of the housing 436 in debris receiving relation with respect to a surface 422 being cleaned, and a second opening 438 disposed in the back portion 440 of the perimeter wall portion 434 of the housing 436 in debris receiving relation with respect to a surface 422 being cleaned.

As in the first preferred embodiment hand-manipulable surface cleaning tool 20, the front portion 432 of the perimeter wall portion 434 of the housing 436 comprises left and right portions 432*l*, 432*r* that are each sloped rearwardly and inwardly towards the first opening 430 that is disposed in the front portion 432 in debris receiving relation with respect to a surface 422 being cleaned. Additionally, left and right deflector flanges 442*l*, 442*r* are mounted on the left and right portions 440*l*, 440*r*, respectively, of the back portion 440 of the perimeter wall portion 434 of the housing 436, so as to be sloped forwardly and inwardly towards the second opening 438 that is disposed in the back portion 440 in debris receiving relation with respect to a surface 422 being cleaned. The left and right deflector flanges 442*l*, 442*r* are preferably made from a resilient metal material so as to minimize the possibility of breaking upon impact with a foreign object, such as a shelving unit or a wall, and so on, and are secured to the housing 436 by adhesive or suitable fasteners (not shown) such as threaded fasteners or rivets.

The selectively movable portion 450 comprises a first door 451 that covers the first opening 430 and a second door 452 that covers the second opening 438. Both the first door 451 and the second door 452 are mounted in vertically slidable relation within front left and right channels 453*l*, 453*r* and rear left and right channels 454*l*, 454*r*, respectively, so as to be movable from their closed positions, as is best seen in FIGS. 4A, 4B and 4C, to their open positions. The first door 451 moves from its closed position to its open position, as indicated by arrow "G" in FIG. 4D, thereby to permit access by debris 424 to the interior 437 of the housing 436, as indicated by arrows "H". The second door 452 moves from its closed position to its open position, as indicated by arrow "I" in FIG. 4E, thereby to permit access by debris 426 to the interior 437 of the housing 436, as indicated by arrows "J".

The front left and right channels 453*l*, 453*r* and the rear left and right channels 454*l*, 454*r* are formed within the housing 436 and also within a crown portion 456 that extends upwardly from the housing 436. Vertically disposed rubber strips (not shown) are mounted within the channels 453*l*, 453*r*, 454*l*, 454*r* to effect a seal between the first and second doors 451,452 and the housing 436 when the first and second doors 451,452 are in their closed position.

The means 470 for moving the selectively movable portion 450, or in other words the first and second doors

451,452, from their closed positions, as is best seen in FIGS. 4A, 4B and 4C, to their open positions, as best seen in FIG. 4D for the first door 451 and FIG. 4E for the second door 452, comprises a first electrically operated solenoid 471 and a second electrically operated solenoid 472.

The elongate wand 478 extends through the crown portion 456 and enters the top of the housing 436. The piston arms 471*p*,472*p* of the first and second solenoids 471,472, respectively, are each connected to the co-operating tab 474 projecting upwardly from the first and second doors 451, 452, respectively.

The bodies 471*b*,472*b* of each of the first: and second solenoids 471,472 are each rigidly mounted to the elongate wand 478 by mounting brackets 476 and suitable threaded fasteners (not shown), primarily for ease of placement of the first and second solenoids 471,472. As can be best seen in FIGS. 4C through 4F and 4G, since the elongate wand 478 slopes upwardly and rearwardly, the first and second solenoids 471,472 and the first and second doors 451,452 are correspondingly sloped.

The selectively operable control means 480 comprises a thumb operable momentary contact single-pole single-throw pushbutton switch 482 mounted onto the elongate wand 478 adjacent the handle 467, and is electrically connected to the first and second solenoids 471,472 by wire 486 secured to the elongate wand 478 by a plurality of "U"-shaped connectors 499 threadibly fastened to the elongate wand 478.

Reference will now be made to FIGS. 5A through 5E, which show a fifth preferred embodiment of the hand-manipulable surface cleaning tool of the present invention, as indicated by general reference numeral 520. The hand-manipulable surface cleaning tool 520 is similar to the first preferred embodiment hand-manipulable surface cleaning tool 20, except that the selectively movable portion 532 comprises both a first door 534 and a second door 536 that together cover the debris passing opening 538. The first and second doors 534,536 are mounted on the front portion 540 of the housing 542 by means of a door hinge 544 having a substantially vertically oriented door hinge pivot axis "DHP5", and permits access to the interior 546 of the housing 542, as aforesaid, through the debris passing opening 538. In this manner, the first and second doors 534,536 are movable, preferably in unison, from their closed positions, as is best seen in FIGS. 5A through 5C, to their open positions, as indicated by arrows "K" in FIG. 5D, thereby to permit access by debris 524 to the interior 546 of the housing 542, as indicated by arrows "L". A coil spring 548 is preferably integrated within each of the door hinges 544 so as to spring bias the first and second doors 534,536 to their respective closed positions.

A pliable rubber strip 550 is mounted one onto the outer vertical edge 552 of each of the first and second doors 534,536 to effect a seal between the doors when they are in their closed position.

The means for moving the selectively movable portion 532, or in other words the first and second doors 534,536, from their closed position, as is best seen in FIGS. 5A, 5B and 5D, to their open positions, as best seen in FIG. 5C, comprises a first electrically operated solenoid 561 and a second electrically operated solenoid 562. As can be best seen in FIGS. 5B through 5D, the first and second solenoids 561,562 are each pivotally mounted to the roof 543 of the housing 542 by means of a threaded fastener 564 in order to accommodate swivelling of the solenoids 561,562 as they move the first and second doors 534,536. The piston arms 561*p*,562*p* of the first and second solenoids 561,562, respectively, is pivotally connected to a co-operating tab 566 projecting rearwardly from the first and second doors 534, 536, respectively. The selectively operable control means 570 comprises a thumb operable momentary contact single-pole single-throw pushbutton switch 572 mounted onto the elongate wand 576 adjacent the handle 574, and electrically connected to the first and second solenoids 561,562 by a wire 578 secured to the elongate wand 576 and the housing 542 by a plurality of "U"-shaped connectors 599 threadibly fastened to the elongate wand 576.

Reference will now be made to FIGS. 6A through 6D, which show a sixth preferred embodiment of the hand-manipulable surface cleaning tool 620 of the present invention, as indicated by general reference numeral 620. The hand-manipulable surface cleaning tool 620 is for suctioning both dust and debris from a surface 622 being cleaned, such as a factory floor, or any other substantially flat surface.

Briefly, the hand-manipulable surface cleaning tool 620 comprises a housing 630 defining a substantially hollow interior 632. The housing 630 has a perimeter wall portion 634 that terminates downwardly in a surface facing peripheral bottom edge 646 that defines a suctioning bottom opening 648. An elongate wand 660 has an inlet end 662 disposed in the housing 630 and an outlet end 634 disposed exteriorly to the housing 630 and connected to a vacuum source 69 by a flexible suction hose 68. An elevating means 680 moves the housing 630 between a lower dust suctioning position and a raised debris suctioning position, as controlled by a selectively operable control means 690.

The various elements of sixth preferred embodiment hand-manipulable surface cleaning tool 620 will now be described in greater detail.

In the hand-manipulable surface cleaning tool 620, the housing 630 includes a substantially hollow interior 632, and having a perimeter wall portion 634 that terminates downwardly in a surface facing peripheral bottom edge 646 that defines a suctioning bottom opening 648 that is continuous with the interior 632 of the housing 630. The perimeter wall portion 634 of the housing 630 has a front portion 635 comprising left and right portion 635*l*, 635*r*, a back portion 636, a left end portion 637, and a right end portion 638. As can be best seen in FIG. 6A, the housing 630 is elongate from the left end portion 637 to its right end portion 638, and is preferably about one to two feet long (from the left end portion 637 to the right end portion 638), and is generally proportionate to the diameter of the Suction hose and wand 660, (about two to four inches high at the center), and about two to three inches from front to back, depending on the specific configuration of the housing 30.

As can be best seen in FIG. 6A, the housing 630 is elongate from the left end portion 637 to its right end portion 638, and is preferably about one to two feet long (from the left end portion 637 to the right end portion 638), and is generally proportionate to the diameter of the suction hose and wand 660, (about two to four inches high at the center), and about two to three inches from front to back, depending on the specific configuration of the housing 30.

The housing 630 is also tapered downwardly from a raised central portion 639 towards each of the left and right ends portions 637, 638, and is also tapered from front to back towards each of the left and right end portions 637,638. In this manner, the left and right end portions 637,638 can be used to vacuum into narrow passageways or corridors, and the like, such as under the bottom of shelving racks or between adjacent shelving racks.

As can be best seen in FIG. 6A, the left and right portions 635*l*, 635*r* are each sloped rearwardly and inwardly to a central portion 633, and the inlet end 662 of the elongate wand 660 is disposed adjacent to the central portion 633, preferably directly behind the central portion 633, in debris receiving relation with respect to a surface 622 being cleaned. Alternatively, the surface facing peripheral bottom edge 646 can be maintained in close proximity to the surface 622 by the use of support mechanisms such as wheels or skid plates.

In the sixth preferred embodiment, as illustrated, the surface facing peripheral bottom edge 646 comprises numerous downwardly Projecting bristles 646*b* that permit the housing 630 of the hand-manipulable surface cleaning tool 620 to slide along a smooth floor without doing damage to either the floor or to the Surface facing peripheral bottom edge 646 of the housing 630. The bristles 646*b* also provide an airflow passageway between the surface 622 being cleaned and the remainder of the housing 630, which airflow passageway has a relatively small cross-sectional area that is preferably less than or even approximately the same as the same cross-sectional area of the internal airflow passageway 664 of the elongate wand 660, so as to permit a suitable high speed airflow therethrough, and subsequently into the housing 30 through the suctioning bottom opening 48. In this manner, air and dust can enter the interior 632 of the housing 630, thus maintaining the housing 630 in dust suctioning relation with respect to the surface 622 being cleaned, as aforesaid. Alternatively, rubber squeegees can be used in place of the bristles 646*b* for applications where water is to be suctioned. Alternatively, the surface facing peripheral bottom edge 646 may be substantially straight or may be ridged. Further, a pair of wheels 625 is mounted on the housing 630 to help facilitate the upward pivoting movement of the housing 630.

Figure 6B:
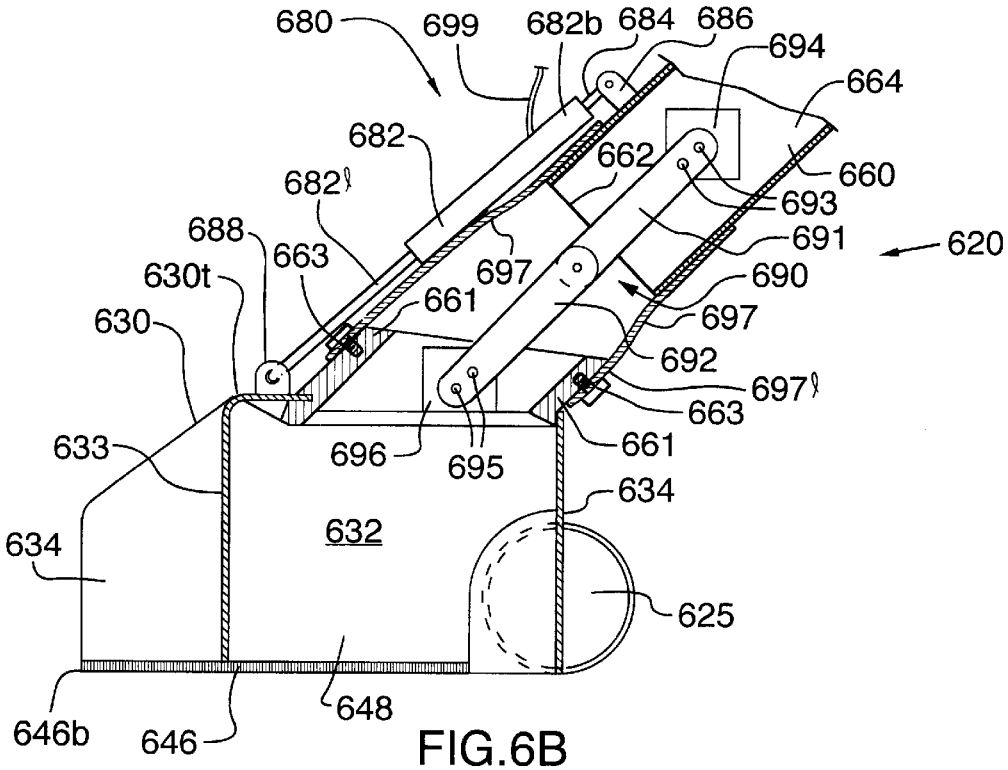
FIG. 6B is a cross-sectional side elevational view of the sixth preferred embodiment of the large area surface cleaning tool of FIG. 6A, taken along section line 6B—6B.
Figure 6C:
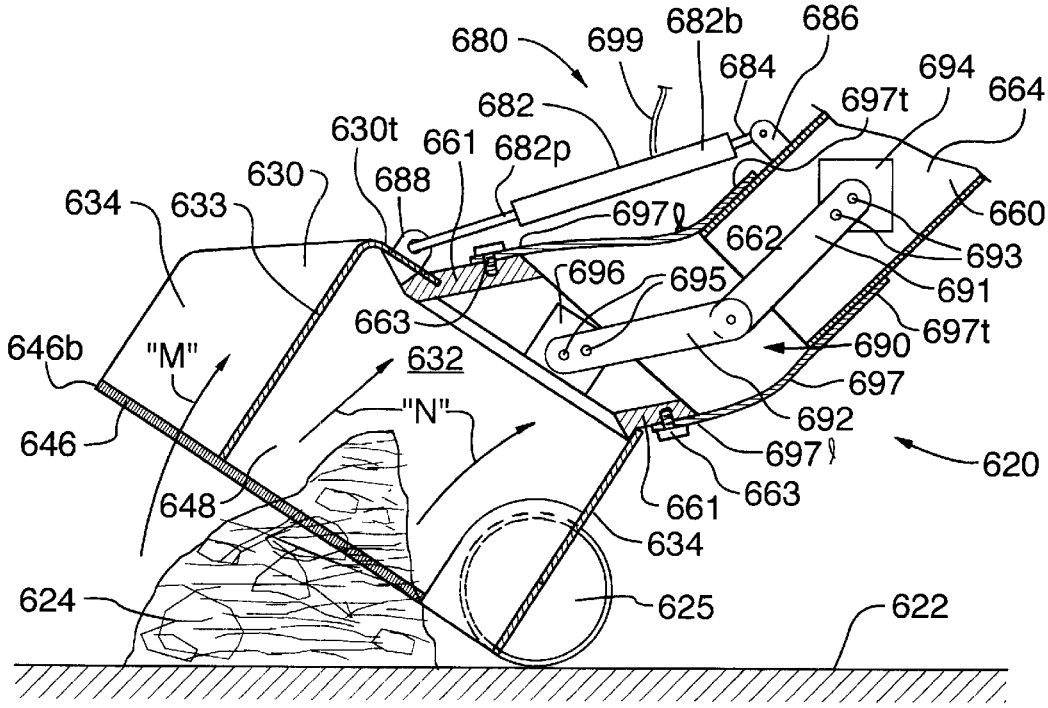
FIG. 6C is a cross-sectional side elevational view similar to FIG. 6A, but with the housing in a raised debris suctioning position, and with debris entering into the interior of the housing.
Figure 6D:
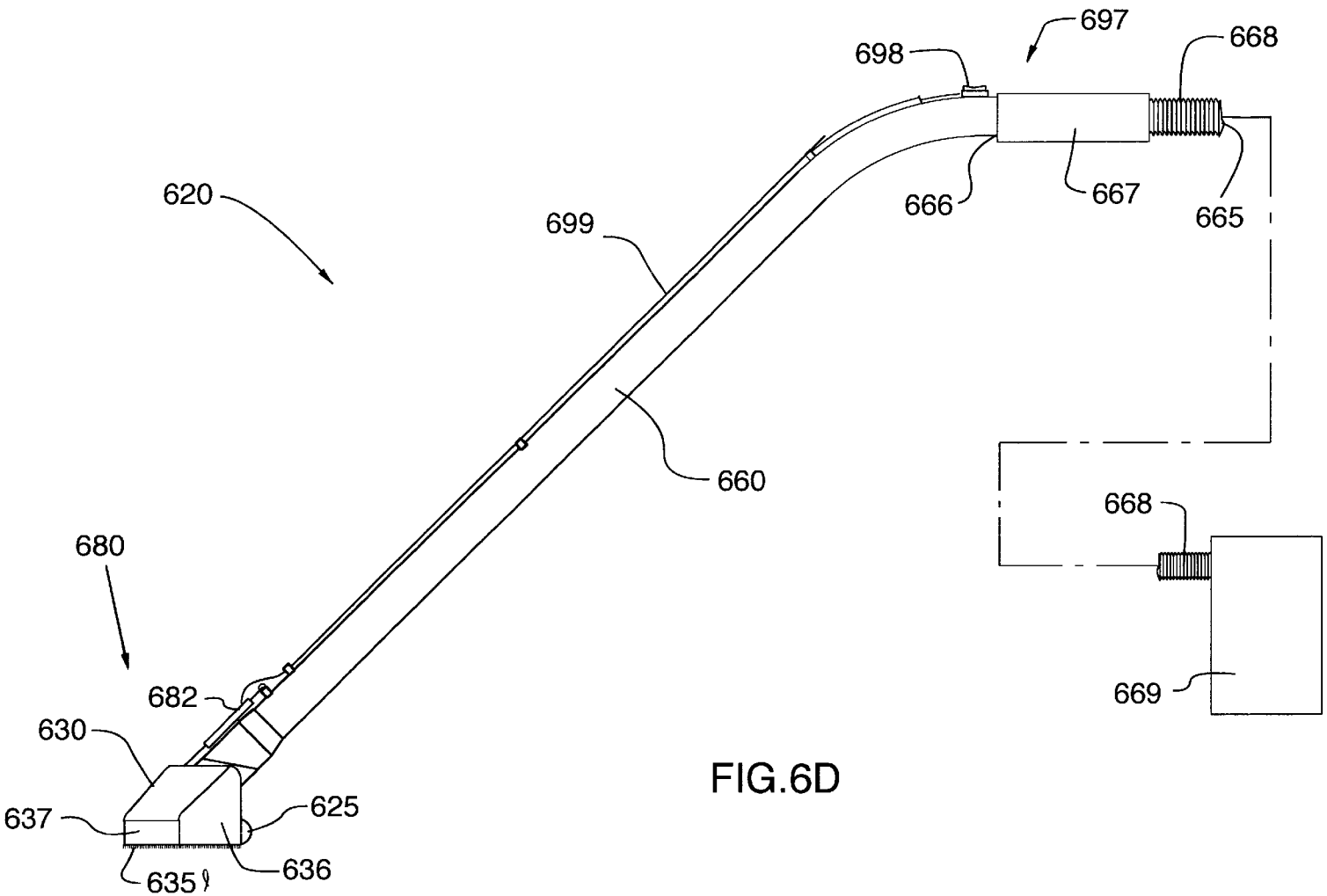
FIG. 6D is a reduced scale side elevational view of the sixth preferred embodiment large area surface cleaning tool of 6A.

As is best seen in FIG. 6D, the elongate wand 660 is interposed between the housing 630 and the flexible suction hose 668 of the vacuum source 669, to permit manual manipulation of the hand-manipulable surface cleaning tool 620. The flexible suction hose 668 also has an airflow passageway 665 that is connected in fluid communication and debris depositing relation to the vacuum source 669. The elongate wand 660 is mounted at its inlet end 662 via a wand connector 661 to the housing 630 such that the inlet end 662 disposed in dust and debris suctioning relation with respect to the substantially hollow interior 632 of the housing 630. The inlet end 662 of the elongate wand 660 is connected in fluid communication and in debris transfer relation via the internal airflow passageway 664 to the opposite outlet end 666 disposed exteriorly to the housing 630, as aforesaid, at a handle 697 that joins the outlet end 666 to the flexible suction hose 668 of the vacuum source 669. The outlet end 666 is thereby also in fluid communication and in debris transfer relation with the vacuum source 669, to thereby permit access by debris through the elongate wand 660 and into the vacuum source 669. The vacuum source 669 comprises both a source of vacuum and a debris receptacle, as is well known in the art. It is also well known that the vacuum source (impeller, pump, etc.) although is commonly beyond the receptacle can also precede the receptacle and thereby have debris flow through it. Preferably, the elongate wand 660 is made from a rigid metal material, such as stainless steel aluminum, UHMW (ultra-high molecular weight) plastic, or any other suitable material, as is well known in the industry.

The elevating means 680 is operatively mounted between the housing 630 and the elongate wand 660 for causing movement of the housing 630 with respect to the inlet end 662 of the elongate wand 660 between a lower dust suctioning position, as shown in FIG. 6B, and a raised debris suctioning position, as indicated by arrow "M" in FIG. 6C, thereby to permit access by debris 624 to the interior 632 of the housing 630, as indicated by arrows "N".

In the sixth preferred embodiment, as illustrated, the elevating means 680 comprises an electrically powered solenoid 682 operatively mounted between the housing 630 and the elongate wand 660. The body 682*b* of the electrically powered solenoid 682 has a bracket member 684 rigidly secured to one end thereof. The bracket member 684 is pivotally mounted onto a tab member 686 that is rigidly secured to the elongate wand 660 by threaded fasteners (not shown) or any other suitable fastening means. The piston arm 682*p* of the electrically powered solenoid 682 is pivotally connected to a co-operating tab 688 projecting upwardly from the top 630*t* of the housing 630.

The elevating means 680 further comprises an articulated leg member 690 having an upper leg member 691 and a lower leg member 692 pivotally connected one to the other and having the upper leg member 691 securely mounted on the elongate wand 660 and the lower leg member 692 securely mounted on the housing 630. In the sixth preferred embodiment, as illustrated, the upper leg member 691 is securely mounted in fixed non-pivoting relation on the elongate wand 660 by means of two threaded fasteners 693 engaged in a mounting block 694 and the lower leg member 692 is securely mounted in fixed non-pivoting relation on the housing 630 by means of two threaded fasteners 695 engaged in a mounting block 696. A flexible bellows 697 made from synthetic rubber or any other suitable materials is adhered at its top end 697*t* to the exterior surface of the elongate wand 660 by means of a suitable adhesive and is secured at its lower end 697*e* to the wand connector 661 by means of threaded fasteners 663. The flexible bellows 697 covers the gap between the inlet end 662 of the elongate wand 660 and the wand connector 661 and accommodates the bending of the articulated leg member 690.

A selectively operable control means 697 is provided for controlling the elevating means 680. The selectively operable control means 697 comprises a thumb operable momentary contact single-pole single-throw pushbutton switch 698 mounted onto the elongate wand 660 adjacent the handle 667 and electrically connected to the solenoid 682 by a wire 699.

In use, the pushbutton switch 698 is actuated by an operator, so as to cause the electrically powered solenoid 682 to retract the piston arm 682*p*, thereby pulling up the housing 630 in an arcuate motion, as indicated by arrow "M" in FIG. 6C, from its lower dust suctioning position to its raised debris suctioning position. The housing 630 pivots about the pivot axis of the pair of wheels 625.

As can be understood from the above description and from the accompanying drawings, the hand-manipulable surface cleaning tool according to the present invention permits suctioning of both dust and debris from a surface without having to pick up the head and set it down onto debris; permits suctioning of both dust and debris from a surface while manipulating the tool with one hand; and permits suctioning of both dust and debris from a surface without separating the tool from a suctioning hose; and provides a cleaning tool that permits suctioning of dust and debris from a surface with increased efficiency and effectiveness, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the hand-manipulable surface cleaning tool of the present invention without departing from the spirit and scope of the accompanying claims.

I claim:

1. A hand-manipulable surface cleaning tool for suctioning both dust and debris from a surface being cleaned, said hand-manipulable surface cleaning tool comprising:

a housing defining a substantially hollow interior, and having a perimeter wall portion that terminates downwardly in a surface facing peripheral bottom edge that defines a suctioning bottom opening in dust transfer relation with a dust and debris outlet disposed in said housing, and having at least one debris passing opening disposed in said perimeter wall portion and in debris transfer relation with said dust and debris outlet, and wherein said dust and debris outlet is connectable to a hand wand means for delivery of dust and debris to a vacuum source;

at least one selectively movable portion operatively mounted on said housing for movement between an open configuration whereat debris is admitted through said debris passing opening and a closed configuration whereat debris is precluded from being admitted through said debris passing opening; and, means for moving said selectively movable portion between said closed configuration and said open configuration.

2. The hand-manipulable surface cleaning tool of claim 1, wherein said at least one selectively movable portion comprises a first door.

3. The hand-manipulable surface cleaning tool of claim 2, wherein said first door is mounted on said housing by means of a door hinge having a door hinge pivot axis.

4. The hand-manipulable surface cleaning tool of claim 3, wherein said door hinge pivot axis is oriented substantially vertically.

5. The hand-manipulable surface cleaning tool of claim 3, wherein said door hinge pivot axis is oriented substantially horizontally.

6. The hand-manipulable surface cleaning tool of claim 2, wherein said at least one selectively movable portion further comprises a second door.

7. The hand-manipulable surface cleaning tool of claim 1, wherein said at least one debris passing opening is adjacent said surface facing peripheral bottom edge.

8. The hand-manipulable surface cleaning tool of claim 7, wherein said at least one debris passing opening extends upwardly from said surface facing peripheral bottom edge.

9. The hand-manipulable surface cleaning tool of claim 1, wherein said perimeter wall portion of said housing has a front portion, and said at least one debris passing opening is disposed in said front portion.

10. The hand-manipulable surface cleaning tool of claim 1, wherein said perimeter wall portion of said housing has a back portion, and said at least one debris passing opening is disposed in said back portion.

11. The hand-manipulable surface cleaning tool of claim 1, wherein said perimeter wall portion of said housing has a front portion comprising left and right portions that are each sloped rearwardly and inwardly, and said at least one debris passing opening is disposed in said front portion between said left and right portions, in debris receiving relation with respect to a surface being cleaned.

12. The hand-manipulable surface cleaning tool of claim 1, wherein said means for moving said selectively movable portion comprises a manually operable cable.

13. The hand-manipulable surface cleaning tool of claim 1, wherein said means for moving said selectively movable portion comprises an electrically powered solenoid.

14. A hand-manipulable surface cleaning tool for suctioning both dust and debris from a surface being cleaned, said hand-manipulable surface cleaning tool comprising:

a housing defining a substantially hollow interior, and having a perimeter wall portion that terminates downwardly in a surface facing peripheral bottom edge that defines a suctioning bottom opening in dust transfer relation with a dust and debris outlet, and having at least one debris passing opening disposed in said perimeter wall portion and in debris transfer relation with said dust and debris outlet disposed in said housing, and wherein said dust and debris outlet is removably connectable in dust and debris delivery relation to a vacuum source;

at least one selectively movable portion operatively mounted on said housing for movement between an open configuration whereat debris is admitted through said debris passing opening and a closed configuration whereat debris is precluded from being admitted through said debris passing opening; and, means for moving said selectively movable portion between said closed configuration and said open configuration.

15. The hand-manipulable surface cleaning tool of claim 14, wherein said at least one selectively movable portion comprises a first door.

16. The hand-manipulable surface cleaning tool of claim 15, wherein said first door is mounted on said housing by means of a door hinge having a door hinge pivot axis.

17. The hand-manipulable surface cleaning tool of claim 16, wherein said door hinge pivot axis is oriented substantially vertically.

18. The hand-manipulable surface cleaning tool of claim 16, wherein said door hinge pivot axis is oriented substantially horizontally.

19. The hand-manipulable surface cleaning tool of claim 15, wherein said at least one selectively movable portion further comprises a second door.

20. The hand-manipulable surface cleaning tool of claim 14, wherein said at least one debris passing opening is adjacent said surface facing peripheral bottom edge.

21. The hand-manipulable surface cleaning tool of claim 20, wherein said at least one debris passing opening extends upwardly from said surface facing peripheral bottom edge.

22. The hand-manipulable surface cleaning tool of claim 14, wherein said perimeter wall portion of said housing has a front portion, and said at least one debris passing opening is disposed in said front portion.

23. The hand-manipulable surface cleaning tool of claim 14, wherein said perimeter wall portion of said housing has a back portion, and said at least one debris passing opening is disposed in said back portion.

24. The hand-manipulable surface cleaning tool of claim 14, wherein said perimeter wall portion of said housing has a front portion comprising left and right portions that are each sloped rearwardly and inwardly, and said at least one debris passing opening is disposed in said front portion between said left and right portions, in debris receiving relation with respect to a surface being cleaned.

25. The hand-manipulable surface cleaning tool of claim 14, wherein said means for moving said selectively movable portion comprises a manually operable cable.

26. The hand-manipulable surface cleaning tool of claim 14, wherein said means for moving said selectively movable portion comprises an electrically powered solenoid.

* * * * *